US006209136B1

(12) United States Patent
Ophardt

(10) Patent No.: US 6,209,136 B1
(45) Date of Patent: Apr. 3, 2001

(54) MULTIPURPOSE, ONE PIECE, VARIABLE NECKTIE

(76) Inventor: Thomas Ophardt, Kapellener Strasse 81, D-47661, Issum (DE)

( * ) Notice: Subject to any disclaimer, the term of this patent is extended or adjusted under 35 U.S.C. 154(b) by 0 days.

(21) Appl. No.: 09/214,319

(22) PCT Filed: Jul. 3, 1997

(86) PCT No.: PCT/EP97/03525

§ 371 Date: Jan. 4, 1999

§ 102(e) Date: Jan. 4, 1999

(87) PCT Pub. No.: WO98/01045

PCT Pub. Date: Jan. 15, 1998

(30) Foreign Application Priority Data

Jul. 4, 1996 (DE) ..... 196 26 991
Jan. 22, 1997 (DE) ..... 297 01 067 U

(51) Int. Cl.[7] ..... A41D 25/00
(52) U.S. Cl. ..... 2/145; 2/144; 2/157; 2/207
(58) Field of Search ..... 2/144–151, 152.1, 2/155, 157, 207

(56) References Cited

U.S. PATENT DOCUMENTS

| | | |
|---|---|---|
| 4,613,992 | 9/1986 | Dabbieri . |
| 5,003,636 | 4/1991 | Marostica . |
| 5,435,011 | 7/1995 | Nicolai et al. . |

FOREIGN PATENT DOCUMENTS

| | | |
|---|---|---|
| 815 936 | 8/1951 | (DE) . |
| 6913 333 | 1/1970 | (DE) . |
| 88 00 518 | 3/1988 | (DE) . |
| 92 06 006 | 7/1992 | (DE) . |
| 88 17 058 U | 8/1992 | (DE) . |
| 579972 | 1/1994 | (EP) . |
| 659 742 | 7/1929 | (FR) . |
| 846674 | 9/1939 | (FR) . |
| 2239958 | 3/1975 | (FR) . |
| 2593680 | 8/1987 | (FR) . |

*Primary Examiner*—John J. Calvert
*Assistant Examiner*—Tejad Patel
(74) *Attorney, Agent, or Firm*—Alston & Bird LLP

(57) ABSTRACT

The invention relates to a multipurpose necktie (1) with an overall length consisting of a neck portion (2) of one width, a tie portion (3), and a front apron (4). The tie portion can be tied to a knot. The multipurpose necktie is made in one piece and variable in that at least one foldable portion of the front apron of a first length of at least 15 cm is constructed from at least two freely foldable flaps. An additional possibility of variation is provided by an adjustability of the overall length of the multipurpose necktie, the overall length being repeatedly variable, and/or by an adjustability of the width of neck portion (2), the width being repeatedly variable. Furthermore, a method is provided, which uses the multiple usability of the multipurpose necktie with advantage. The multipurpose necktie of the present invention is characterized by its variety for different occasions, be they of the formal or casual kind. The multipurpose necktie also offers the possibility of being suitably worn not only by men, but also by women as a scarf of the like with blouses.

12 Claims, 19 Drawing Sheets

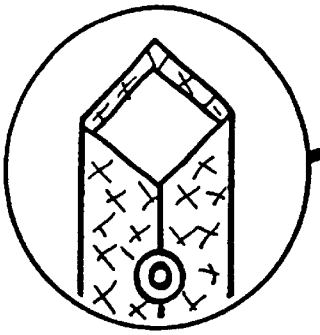
Figur 22
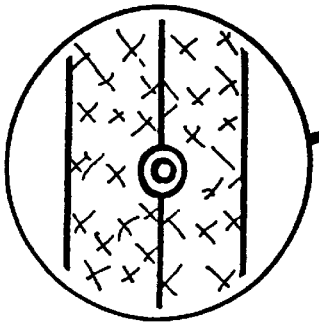
Figur 23
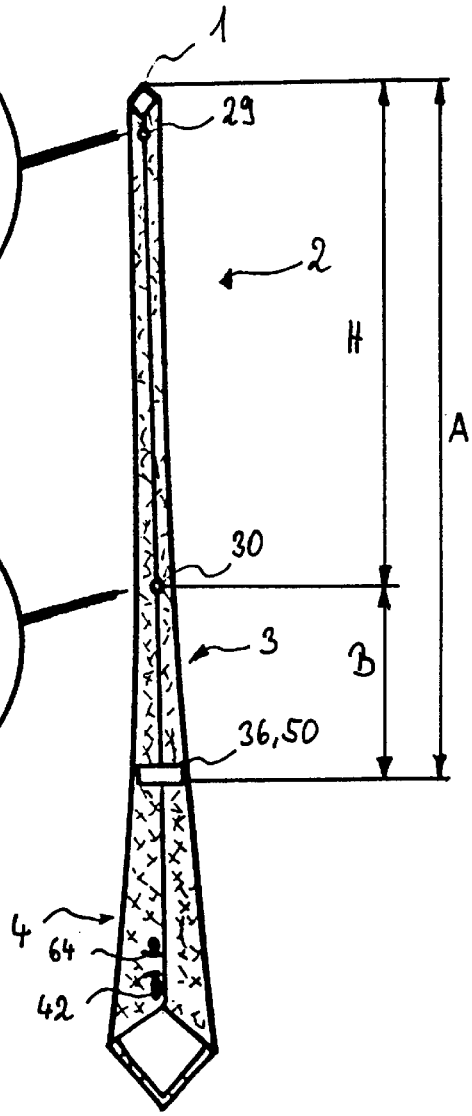
Figur 21
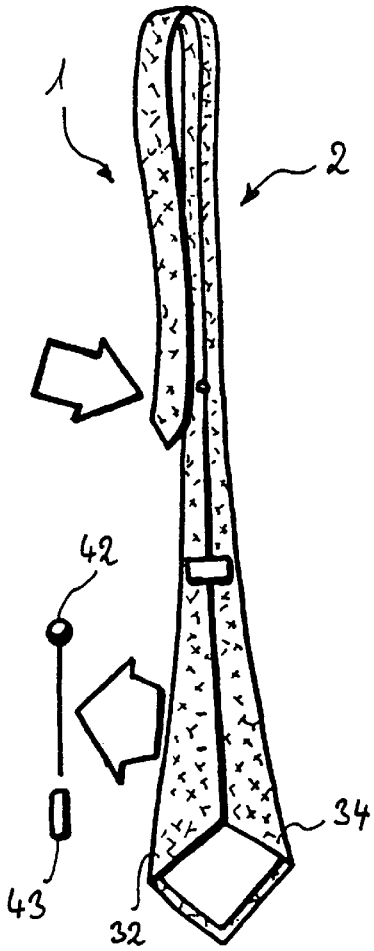
Figur 24

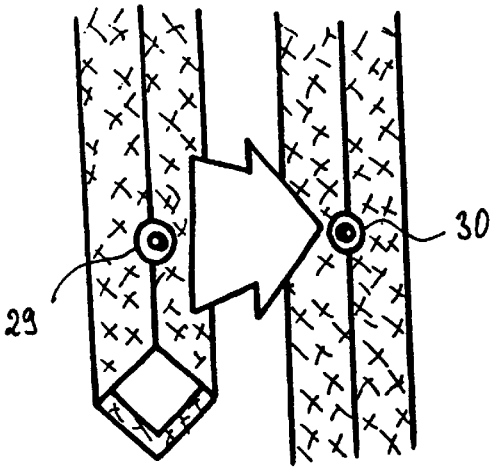
Figur 25
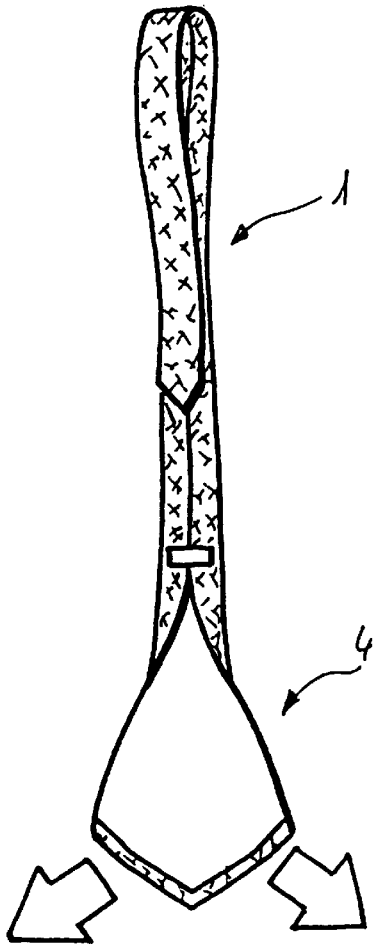
Figur 26
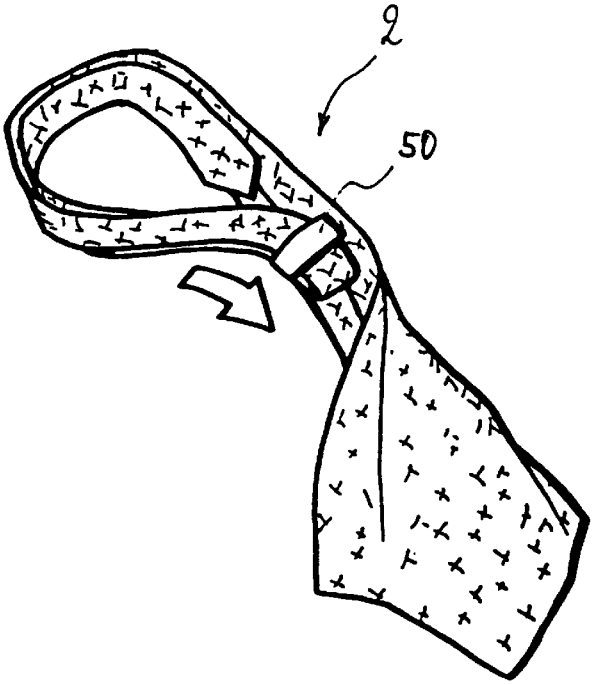
Figur 27

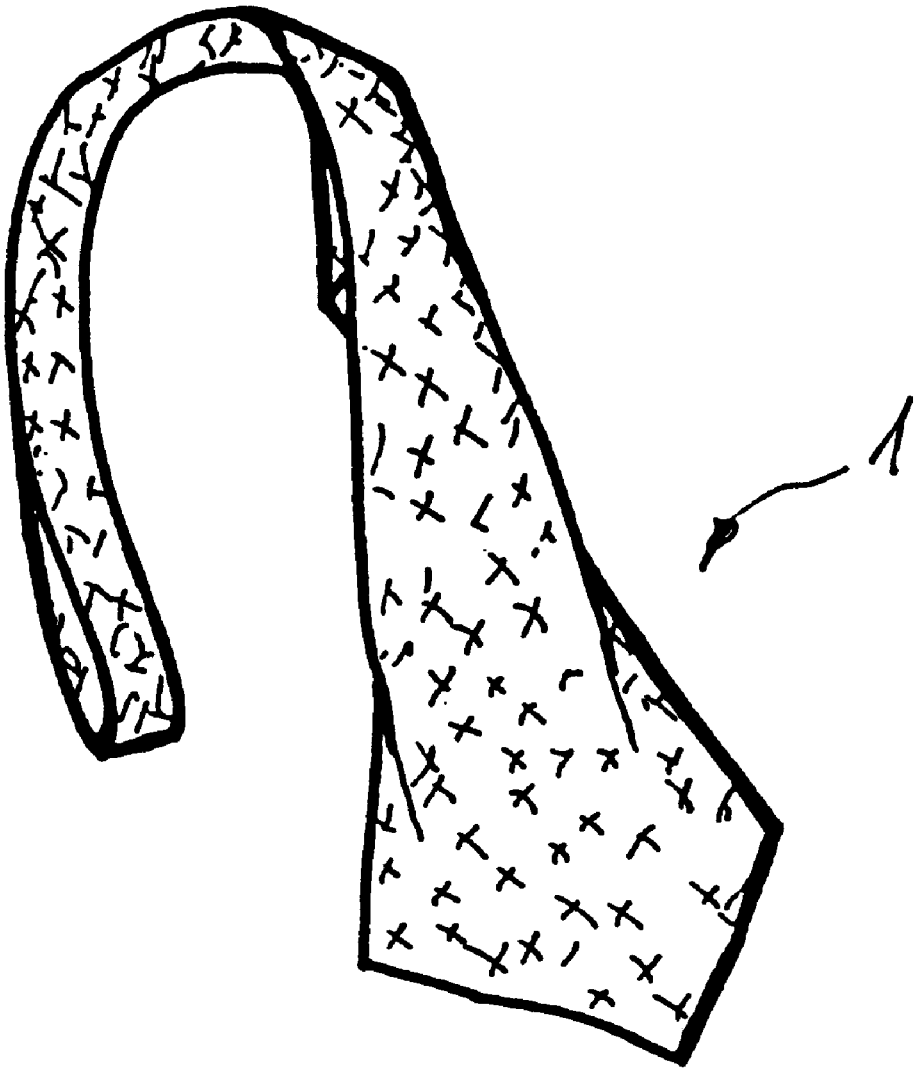
Figur 28

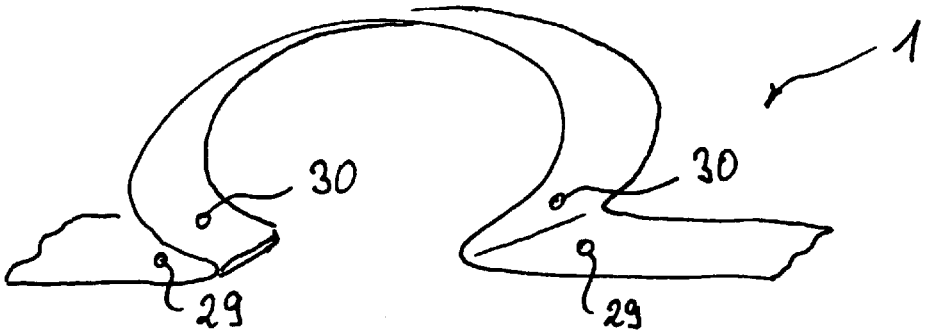
Figur 45
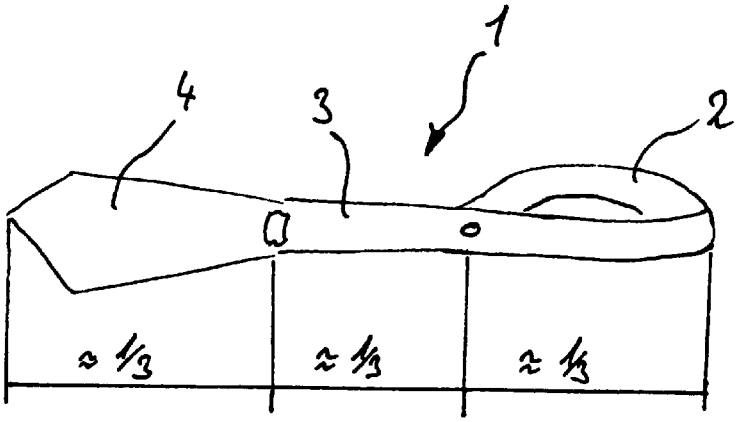
Figur 46
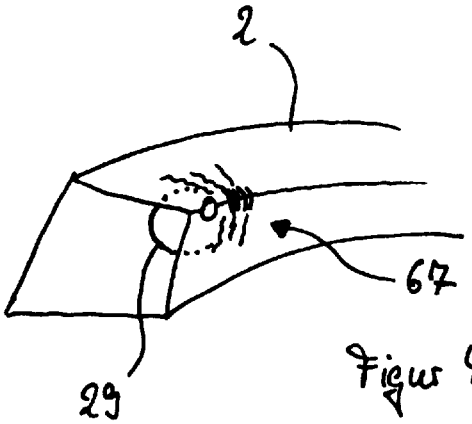
Figur 47

MULTIPURPOSE, ONE PIECE, VARIABLE NECKTIE

BACKGROUND OF THE INVENTION

The present invention relates to a multipurpose necktie with a neck portion, a tie portion, and a front apron. The tie portion may be looped to form a knot. A multipurpose necktie as used herein is also understood to include a cravat or long necktie, a neck cloth, or even a kind of scarf, provided the cut of same changes over their length.

Normally, neckties comprise a tie portion, a neck portion, and a front apron. It is not necessary that same exhibit a clear separation from one another. Preferably, the tie portion is looped to form a knot in such a manner that a portion of the front apron covers with its free end the projecting length of the neck portion. Thus, the selection of the necktie material and the configuration of the front apron essentially determine the decorative appearance of the necktie. However, both the configuration and the selection of the necktie material are not arbitrary. In the manufacture of neckties, the material may not be embroidered or designed as desired, for example, be made of lace. This would not support a possibly traditional further processing of a necktie material. On the other hand, the selection of the necktie material is likewise restricted in that requirements exist that result from the use of a finished necktie. These requirements are, for example, longevity, ruggedness, tying quality, washability, and/or pressability. As a result, it is possible that optical quality may become insignificant in the selection of a necktie material. A further restriction of a necktie results from stylish ideas, which ultimately permit for certain areas or occasions only different configurations of a long necktie. While festive occasions require a rather modest form of a necktie, neckties with colorful, in part even loud designs are preferred in particular in the area of leisure-time activities. In addition, likewise the taste as regards styling a necktie changes in the course of time. This change imparts to a necktie an only limited usable life. Known are neckties with exchangeable individual components. DE 88 17 058 U1 discloses a necktie, wherein at least the front apron is exchangeable. EP 0 579 972 discloses a long necktie of a length that is composed of different, combinable individual sections. These individual sections may have different designs and/or patterns. Likewise, DE 92 06 006 U1 discloses a multipart necktie with a front apron consisting of different, but combinable portions. Between these portions it is possible to hide a cleaning cloth for glasses. In comparison therewith, FR 73 37 114 shows a necktie wherein a front apron can be inserted into a neck portion.

Furthermore, DE 69 13 333 discloses a cravat of the kind of a long necktie with two layers of necktie material. Same form each a display surface, and both display surfaces are in part joined to each other at the edge of the necktie. By unfolding one of the two display surfaces, the other one is exposed. Another kind of a multipurpose use is shown in FR 25 93 680. The long necktie shown therein is described a surprise necktie, since its front apron can be unfolded for removing a bow tie from a thus-formed space.

FR-A-846 674 discloses a long necktie, which has to free ends. One is the end of the front apron, the other is the end of the neck portion of the long necktie. It a tied condition, both ends can overlie each other such that none the two ends can be moved against each other. To this end, the narrower end of the neck portion is overlapped by a freely foldable flap of the front apron and secured to same. This is to avoid that the narrower end of the neck portion becomes visible, when the front apron dislodges.

U.S. Pat. No. 4,613,992 discloses again a multipurpose necktie that permits a variety of tying possibilities of the long necktie, namely both as a cravat and, for example as an Ascot. To this end, the long necktie consists of a neck tying portion and a square of fabric attached thereto. The fabric of the square may be folded depending on the desired form of the multipurpose necktie.

It is the object of the present invention to provide a necktie, which is capable of serving several purposes, and provides by itself different styles. Furthermore, it is an object of the invention to provide a suitable method of using the multipurpose capabilities of the necktie with the inclusion of different styles of the necktie.

SUMMARY OF THE INVENTION

The multipurpose necktie is made in one piece with an overall length consisting of a neck portion of one width, a tie portion, and a front apron. The tie portion can be looped to a knot. The multipurpose tie is made variable by constructing at least one foldable part of the front apron of a first length of at least 15 cm with at least two freely foldable flaps. In this connection, an additional possibility of variation is present by

- an adjustability of the overall length of the multipurpose necktie, the overall length being repeatedly variable; and/or
- an adjustability of the width of the neck portion, the width being repeatedly variable.

Freely foldable means that the two flaps are not permanently joined to each other by a seam. This allows varying the width of the foldable part as desired. Furthermore, the variable multipurpose necktie with a neck portion, a tie portion, and a front apron is made in one piece. The use of a single multipurpose necktie for different occasions does not require carrying always along additional parts for the multipurpose necktie. The multipurpose necktie itself guarantees the variability. Therefore, the freely repeatable foldability is likewise an independent inventive idea which also stands by itself.

Furthermore, variability is achieved in particular by an adjustability of the overall length and/or the width, preferably in the neck portion. This allows use of the multipurpose necktie not only for festive events, but also as a scarf or casual neckerchief. Thus, for example, a multipurpose necktie having a length of about 1.5 m and being worn as a cravat is shortened to an overall length of about 1.1 m, when this multipurpose necktie is used as a scarf or a neckerchief.

The method of changing a multipurpose necktie with a neck portion, a tie portion and a front apron from a necktie form to a scarf form includes the following steps:

- Repeatedly shortening the neck portion by means of a fastening device;
- Unfolding at least two freely foldable flaps of the front apron up to a passthrough and/or a seam in the front apron that is protected against ripping, in particular a bar tack;
- Wrapping the tie portion about itself until the passthrough or the seam just disappears below a thereby formed scarf knot; and
- Covering the formed scarf knot with the unfolded flaps.

It is possible to reverse the conversion and use the multipurpose necktie as a long necktie.

A partial insertion of the shortened neck portion through the passthrough will facilitate in particular the wrapping of the tie portion, so as to obtain an adequately wide and thick scarf knot. It will be especially advantageous, when the wrapping of the tie portion and the formation of the scarf knot are performed such that a neck width is adjusted by pulling at the neck portion. The use of the multipurpose necktie as a scarf is supported by the fact that a part of the neck portion is repeatably widened.

A particularly preferred embodiment of the invention provides that the front apron comprises at least in a foldable part at least three freely foldable flaps. When folded, the flaps may come to lie against one another or even overlap at least in part. Advantageously, they are combinable with one another. To this end, they are provided with suitable fastening means. In this connection, it has shown to be advantageous that the foldable part of the front apron measures at least 25 cm, in particular at least 30 cm, and preferably at least 35 cm. This allows to avoid that folds forms when the opened foldable part is used in an embodiment of the present invention, so as to form a kind of Ascot-type overlap of the knot that is preferably made in tie portion. In this connection, Ascot means the following: an Ascot tie is looped about itself approximately like a scarf without forming a knot, and it forms on the neck of the Ascot tie wearer a clearly wider coverage than a conventional long necktie, with the end of the Ascot tie extending into the partially opened shirt and disappearing therein from the visual range.

A preferred embodiment of the multipurpose necktie provides that the width of at least one foldable part of the front apron can be varied adjustably. It will be advantageous, when the width of the partial length of the front apron can be unfolded from a preadjusted width corresponding to a multipurpose necktie to that of a scarf. In particular, it is to be attempted to enlarge the width by at least 25%, preferably by more than 50%, and in particular by more than 100%. Depending on the construction of the front apron, namely whether there are two or more freely foldable flaps, a corresponding attempted maximal width is distributed over these different flaps. A particularly preferred embodiment of a multipurpose necktie provides that the foldable part measures at least 40 cm. In this instance, the flaps can be freely opened to the end of the front apron of the multipurpose necktie. This allows to accomplish that regardless where necktie is looped to form a knot, be it in the tie portion or even in the front apron, there will always be sufficient material to achieve the Ascot-type form of an adequate length for insertion into a shirt.

To be able to use a multipurpose necktie even in the Ascot-type form so that disturbing differences between the width of the front apron and the neck portion are absent, the latter also possesses the capability of serving several purposes. In one embodiment, the neck portion or a section thereof contains no inlay or interfacing. Instead, the section is not made tubular, but foldable and of such a width that the material coming to lie against the neck, preferably silk, exhibits in its folded state together with the outer material approximately the material thickness of the remaining multipurpose necktie. The folding and unfolding of this section is supported on the one hand by a stretch effect of the used fabric or fabrics themselves and on the other hand by the cut. Preferably, the necktie material is cut from the woven fabric such that these individual parts extend about 45° offset from the vertical of the grain of the woven fabric. Thus, the fabric of the individual parts is imparted a certain flexibility. The respective ends of the section that merge again into tubular form, are furthermore formed such that when being pulled, the widening quasi rolls up and thus tends to orient toward its axially extending center line. This may be accomplished in that the edges of the widening are gently cut, and finally attached to each other for a transition from the open to the tubular state. At the same time, this prevents puckering in the neck region, so that additional fabric allowance or a correspondingly wide cut does not interfere with wearing the multipurpose necktie.

A further development of this embodiment provides that the inner fabric, preferably silk, is sewn at the respective ends of the section to the outer fabric. However, a part of the inner fabric that is unattached then follows. Advantageously, same may tucked into the tubular portion of the neck portion and facilitate, in cooperation with another free part or the neck portion, a closing of the neck portion by suitable means. When the multipurpose necktie is used in its Ascot-type form, it will not be necessary to tie a knot. Instead, the unfolded front apron may now be wrapped with the tie portion several times about the neck portion.

In a further, especially preferred embodiment of the multipurpose necktie, it is possible to vary repeatably at least in part the length and/or the width of primarily its neck portion. In the following, further different possibilities are described with reference to the particularly preferred variation of the neck portion.

One embodiment of a multipurpose necktie has a V-shaped cut. Same is located in an end region of a foldable region of the neck portion. Preferably, the V-shaped cut also defines same, so that the tie portion or the front apron directly follows this cut. When a pull is now exerted on the neck portion, the material of the neck portion will stretch, which is encouraged by the V-shaped cut. The latter permits that the neck portion has a greater width in its unpulled state than in its pulled state. A region in the neck portion that is to be varied, can be defined in that the neck portion has two V-shaped cuts. These cuts constitute the limits of the variable neck portion. Besides using a 7-shaped cut, it is likewise possible to use any other cut that ensures repeatable variation of the neck portion.

The unfoldability of the neck portion can also be obtained by the kind of arrangement of the fabric orientation. As previously described, in the foldable region the fabric orientation exhibits a different elasticity behavior, when the foldable region has a fabric orientation that is rotated by 30° to 60°, in particular by 45° relative to another region of the multipurpose necktie. The elasticity behavior depends on the kind of the fabric used, and it can be purposefully adjusted by changing the structure of the fabric. The region with the rotated fabric cut is firmly connected to adjacent regions, for example by one or more seams. In this manner, it is guaranteed that the variable multipurpose necktie consists of one piece. In the meaning of the invention, one piece means that the neck portion, the tie portion, and the front apron are joined to one another such that they can be again separated from one another only by destroying the multipurpose necktie.

A further embodiment of the multipurpose necktie has a neck portion, which can be repeatably shortened and again lengthened in its length in a securely fastened manner. The fastening prevents, for example, the shortened length of the neck portion from changing again involuntarily. Thus, it is ensured that the variability of the multipurpose necktie remains, even in the case of multiple changes over a long period of time. According to a further aspect of the invention, the neck portion is adjustably variable. This means that the repeatable length variation is not initially established for the variable multipurpose necktie. For example, an adjustable variability of the neck portion can be accomplished by means of a displaceable fastening or even by surfaces adhering to one another.

To vary the neck portion, be it in its length and/or in its width, at least the neck portion of a preferred embodiment has at least one fastening device. The fastening device may, for example, be a just-described securement in position. In one embodiment of the multipurpose necktie, the fastening device is at least adjacent to a beginning of the variable neck portion. This allows to cover, for example, this variable neck portion or even to leave it at least only in part exposed. When the beginning of the variable neck portion corresponds to the transition from the neck portion to the tie portion, or when the fastening device is present at least adjacent the tie portion, it will be possible to shorten the neck portion to a very great extent. For the variability of the multipurpose necktie as well as its length reduction it will also be advantageous, when a fastening device is present at least adjacent a passthrough. In the meaning of the invention, a passthrough means that a portion of the multipurpose necktie can be extended through this passthrough. The passthrough may be a label, a loop, or even, for example, a cut in the tie portion or front apron. The cut can be realized such that it permits insertion of the neck portion, thereby making same disappear in the multipurpose necktie. When two cuts are made, it will be possible to pass the inserted neck portion through the multipurpose necktie and subsequently to secure same at the fastening device. To this end, the multipurpose necktie may have not only one fastening device, but even a plurality thereof. As a result, it is possible to vary the length and/or the width of the neck portion in different adjustments. To this end, the fastening devices among themselves are interconnectible.

In a further embodiment of a multipurpose necktie, the fastening device is covered at least in part with material, in particular fabric. In this manner, it is also possible to use fastening devices with edges. The cover prevents a person from becoming injured when handling the multipurpose necktie. This is especially important in the regions of the multipurpose necktie that lie against the neck. Furthermore, it is possible to use the material as an elastic protective cover. When a knot is tied in the multipurpose necktie extending around a person's neck, and same is pulled tight, the material will prevent the fastening device located in the neck region from impressing and forming pressure marks. Furthermore, the cover permits a very wide possibility of material selection for the fastening device. In particular, it is possible to use in the case of a suitable cover for the fastening device nonetheless materials, such as nickel, copper, or the like, which cause in some persons an allergic skin reaction. Furthermore, it is possible to use the fastening device for securing to one another fabric layers, which form the neck portion, the tie portion, or the front apron. To this end, the fastening device may extend in full or in part through all fabric layers, so as to secure thereafter the remaining fabric layers. However, it may also be arranged on a first fabric layer, so as to secure thereafter the remaining fabric layers. In particular, it is possible to arrange the fastening device such that it can be concealed, this means that it is invisible. This may be realized not only in a fold of the multipurpose necktie, but also by the material that covers the fastening device. A further preferred embodiment has a gathering of the material adjacent the fastening device. The effect thereof is that the material covers the fastening device at least at its edge, so as to avoid direct skin contact at least with the edge.

Preferred fastening devices are spring studs or spherical parts. When same are combined, they result in a snap fastener. With the use of same, it is possible in an uncomplicated manner to realize and again undo the variation in the length and/or width of the neck portion. Further, possible fastening devices are pins, adhesive surfaces, buttons with a corresponding counterpart, loops, or the like.

Besides the variability of the one-piece multipurpose necktie based on the length and/or width variation of its neck portion, same has in an advantageous embodiment a tie portion of such a length that a knot can be fully tied by wrapping the tie portion two to five times, preferably three times about itself. The tie portion that extends between the front apron and the neck portion can be shown by suitable markings. Likewise, the tie portion may be of a different material than the neck portion as well as the front apron. Besides other marking possibilities, such as by threads, short changes in the kind of weave, or the like, it is also possible to use the fastening device for defining the region that is available for forming a knot. As a result of limiting the length of the tie portion, it is always defined, depending on the intended use of the multipurpose necktie, how much material can be tied in the knot. Dependent therefrom are also the kind of knot and its thickness.

A further limitation of the tie portion can be realized by a corresponding arrangement of the passthrough. Same is arranged such that when the tie portion is wrapped about itself two to five times, it just disappears in the knot. Depending on the length of the tie portion and thus likewise on the thickness of the knot being tied, the passthrough is arranged at least adjacent the front apron. By additionally arranging a fastening device at least adjacent the passthrough, it is also possible to secure there the neck portion, if need arises.

According to an advantageous concept of the invention, the front apron is designed for repeatable unfolding and folding. This allows using the multipurpose necktie not only as a long necktie, but also as an Ascot-type scarf. This repeatable unfolding and folding capability itself is predetermined by a corresponding configuration of the front apron. This does just not mean that the front apron of a normal, long necktie is simply folded. The front apron of the multipurpose necktie is capable of unfolding in particular up to a tearing protection in a seam, in particular a bar tack. The seam may still extend in the front apron, but likewise in the tie portion. It serves to join to a tube one or more fabrics, which then form the corresponding front apron or tie portion. Likewise, it is possible to realize the front apron such that the seam starts only in the tie portion. The tearing protection, which prevents destruction of the seam, may then be used to mark this transition. Besides a bar tack serving as a tearing protection, it is also possible to use, for example, a label. Same is then secured around the seam in a corresponding lasting mariner.

The multiple usability of the multipurpose necktie is further supported in that the front apron and/or adjacent portions comprise means for forming folds. These means will be useful, when the multipurpose necktie is used in the fashion of an Ascot tie or as a scarf. Such means are small woven-in or inserted threads, gathering tape, one or more slits, primarily in an inlay that is arranged in the front apron. When tying the multipurpose necktie, one may engage in the slits in the inlay, which will then lead to the formation of folds. This fold formation is again especially important, when the front apron is constructed from two or more foldable flaps. Same are joined in particular sewed to one another. Preferred is a front apron that has three flaps sewn together from three individual pieces. The seam between the individual flaps can be used to attach an inner layer in the front apron. Besides the inner layer, the front apron may also contain an inlay. Same can be arranged between the inner layer and the fabric of the front apron. To arrange the inner layer and/or the inlay in the front apron, same may have fastening means, which may be straps, loops, slings, or even cling fasteners. In accordance with the variability of the multipurpose necktie, one embodiment thereof comprises an inner layer and/or inlay, which consists of a scarf material. A preferred scarf material is, for example, cashmere. Likewise, it is possible to use polyester, cotton, silk, or the like, which have a corresponding processing for a scarf. Preferably, the inlay is glued and sewn to the front apron. In another preferred embodiment of a multipurpose necktie, the inlay is attached to the inner layer.

A special multiple usability results, when the inlay can be attached for exchange. This will be useful in an arrangement adjacent a passthrough and/or a fastening device, where it is advantageous to secure the inlay. The fact that the inlay is exchangeable does not contradict the concept of a multipurpose necktie in one piece. The multipurpose necktie as such with front apron, tie portion, and neck portion remains unchanged. Particularly suitable for a passthrough has shown to be a pin with a protective cap for the needle tip, which also constitutes an independent inventive idea. This pin may designed in a manner comparable to a safety pin or a necktie pin or according to a basting pin. The important feature of the pin for the multipurpose necktie is that the pin and/or the protective cap comprise an additional means for attaching to the multipurpose necktie. This allows opening the needle, while one of the two parts remains on the multipurpose necktie. The other part, for example, the pin itself may in this instance be held in the hand.

A further inventive configuration of a variously usable multipurpose necktie with a neck portion, a tie portion, and a front apron has in one part of the multipurpose necktie, preferably in the tie portion or front apron, an opening, in particular a slit through which an inlay or inner layer can be pulled out and then be used as a scarf. When pulled out, the inlay or inner layer is wider than the front apron of the multipurpose necktie in the long necktie form. Advantageously, the inlay is attached exclusively in the vicinity of the slit, so that it can function on the one hand as an inlaid lining and, on the other hand, be easily pulled out of the slit. Advantageously, the slit itself extends in a surface that is invisible when the multipurpose necktie is worn, so that when the scarf is used in the fashion of an Ascot tie, it will be necessary to turn only the multipurpose necktie.

Preferred is also an embodiment of a multipurpose necktie with a neck portion that has its own closure, for example, by means of buttons and buttonholes or, however, by means of snap fasteners or a cling closure. In this instance, it is possible to use a particularly well cleanable, preferably washable tube that is pulled as a cover over the closing region. This cover itself has its own independent and inventive characteristic. Furthermore, this cover has two slits, through which a part of the front apron can be pulled, in particular in such a manner that a kind of stylized knot is formed for the collar closing.

BRIEF DESCRIPTION OF THE DRAWINGS

Advantageous embodiments and further preferred features are described in more detail with reference to the following drawings. Favorable further developments result from advantageous combinations of individual features of different embodiments. In the drawings:

FIGS. 21 to 33 show the use of a multipurpose necktie as a shawl tie with tying a loop;

FIG. 45 shows a further embodiment for varying the overall length of the multipurpose necktie;

FIG. 46 shows advantageous dimensioning of the multipurpose necktie; and

FIG. 47 a gathering of material for covering a fastening device.

DETAILED DESCRIPTION OF THE PREFERRED EMBODIMENTS

Figure 1:
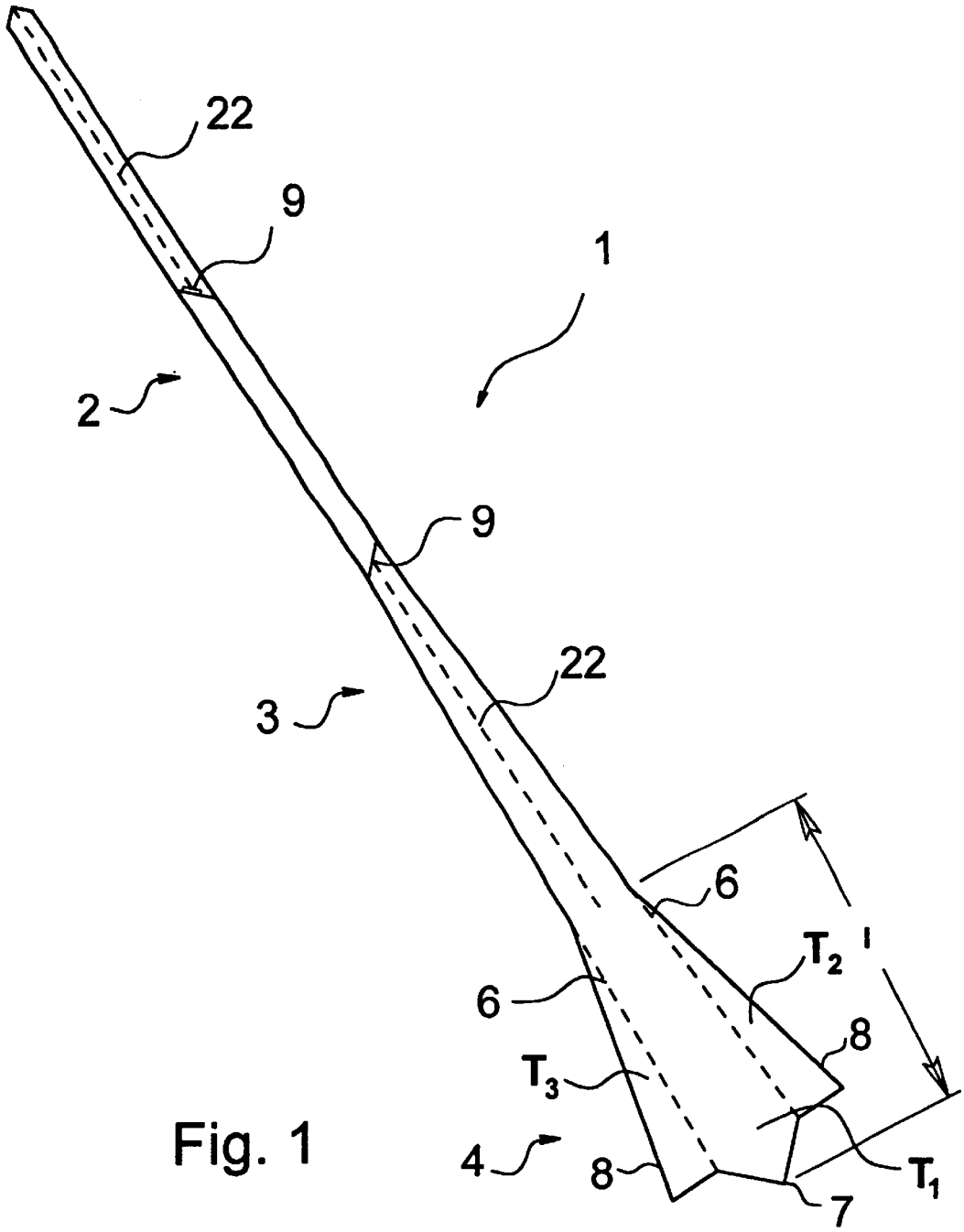
FIG. 1 shows a one-piece multipurpose necktie with an opened foldable part of a length 1.

FIG. 1 shows a one-piece multipurpose necktie 1 with a neck portion 2, a tie portion 3, and a front apron 4. A foldable part 5 of front apron 4 is composed over a length 1 of three foldable flaps $T_1$, $T_2$, and $T_3$. The central flap $T_1$ has on each side a further flap $T_2$ and $T_3$. Same possess each individually with central flap $T_1$ a preferred fold line 6 which is indicated in dashed lines. Both the neck portion 2 and the tie portion 3 of this embodiment are likewise made foldable, which is indicated by a separating line 7 shown in dashed lines. The surfaces overlying one another in the folded state, which form in the unfolded state advantageously the inner side, i.e., the side of facing the neck region, consist advantageously of a different fabric or material than the other side. Preferably used for the inner side is silk or even a cleanable, in particular washable material, for example cotton. Likewise preferred is a material difference between the neck portion 2 and the tie portion 3 relative to the front apron. Whereas it is preferred to make the former two of silk and/polyester, the front apron consists of a material, which is favorable to process in the decorative field. Since the front apron 4 comprises the foldable part 5 in which the flaps $T_2$ and $T_3$ can be opened, so that they are visible, when the multipurpose necktie is worn, the fabric of the front apron 4 is double stitched from its tip, i.e. it is provided with a thin lining material. Preferably, the front apron has this double seam up to about two thirds of its height from the tip 7. Furthermore, it is advantageous to provide a seam reinforcement at least in the foldable part 5 along an edge 8 of front apron 4. This provides the flaps with a certain stiffening and thus imparts to them an additional stability. To this end, it is preferred to fold over each of these edge regions and sew these seams together. In a further development of the multipurpose necktie 1, same has a marking 9 that indicates the beginning of the portion of multipurpose necktie 1 which is to be wrapped about itself. The marking 9 may be arranged as a function of different neck widths, so as to facilitate tying of a knot in adaptation to different persons. Advantageous for marking 9 is a colored region or even a different surface quality. In a preferred embodiment a marking 9 is arranged on the multipurpose necktie 1 in such a manner that it offers an indication for a scarf knot or Ascot-type knot, i.e., with unfolded flaps. Advantageous is to dimension the length measurement of the tie portion 3 such that when wrapping the tie portion 3 several times about itself for tying a knot, one part of the foldable part 5 of front apron 4 lies above or just behind the tied knot. Thus, it is accomplished that an adequate width lies in Ascot-type manner above the knot and can cover a corresponding shirt opening. A particularly preferred embodiment provides for a double tied Windsor knot, since same forms a corresponding wide knot, so as to be able to ensure a satisfactory neck closing. A Windsor knot is understood to be a knot with a double looping that is tied as follows: first, a wide tie portion 3 of multipurpose necktie 1 is crossed over a narrower section of tie portion 3 and guided to the left. Subsequently, the wider section of tie portion 3 is wound from the back to the front over the narrower section of tie portion 3, so that a neck loop is formed. Now, the wider length is wrapped downward and, contrary to a single Windsor knot, it is wound again about the formed neck loop. Now, the wide section is pulled to the right, where it is again wrapped twice about the neck loop. After the second wrap, the wide section is inserted through the neck loop and extended to the left. Over the resultant knot, the wide section is returned to the right, and subsequently pulled from behind in upward direction through the neck loop. Now, can be inserted through the loop formed in front and be pulled tight. This favorable configuration of a knot results in the possibility of using the tied knot as a spacer for the overlying, opened foldable part 5. Furthermore, such a thick and wide knot may be used especially well for fastening means, for example, a tiepin. Possible injury hazards by the tip of the pin are lessened by the thickness of the knot. Furthermore, the combination of a multipurpose necktie 1 with the possibility of functioning as a scarf or an Ascot tie offers the great advantage in comparison to an Ascot tie which is also provided in a conventional manner with an eyelet at one end and is therefore defined as regards its possible adjustments, namely that it can be adapted continuously to the neck circumference as in the case of a necktie. In this manner, it is accomplished to use a multipurpose tie 1 for different occasions.

Figure 2:
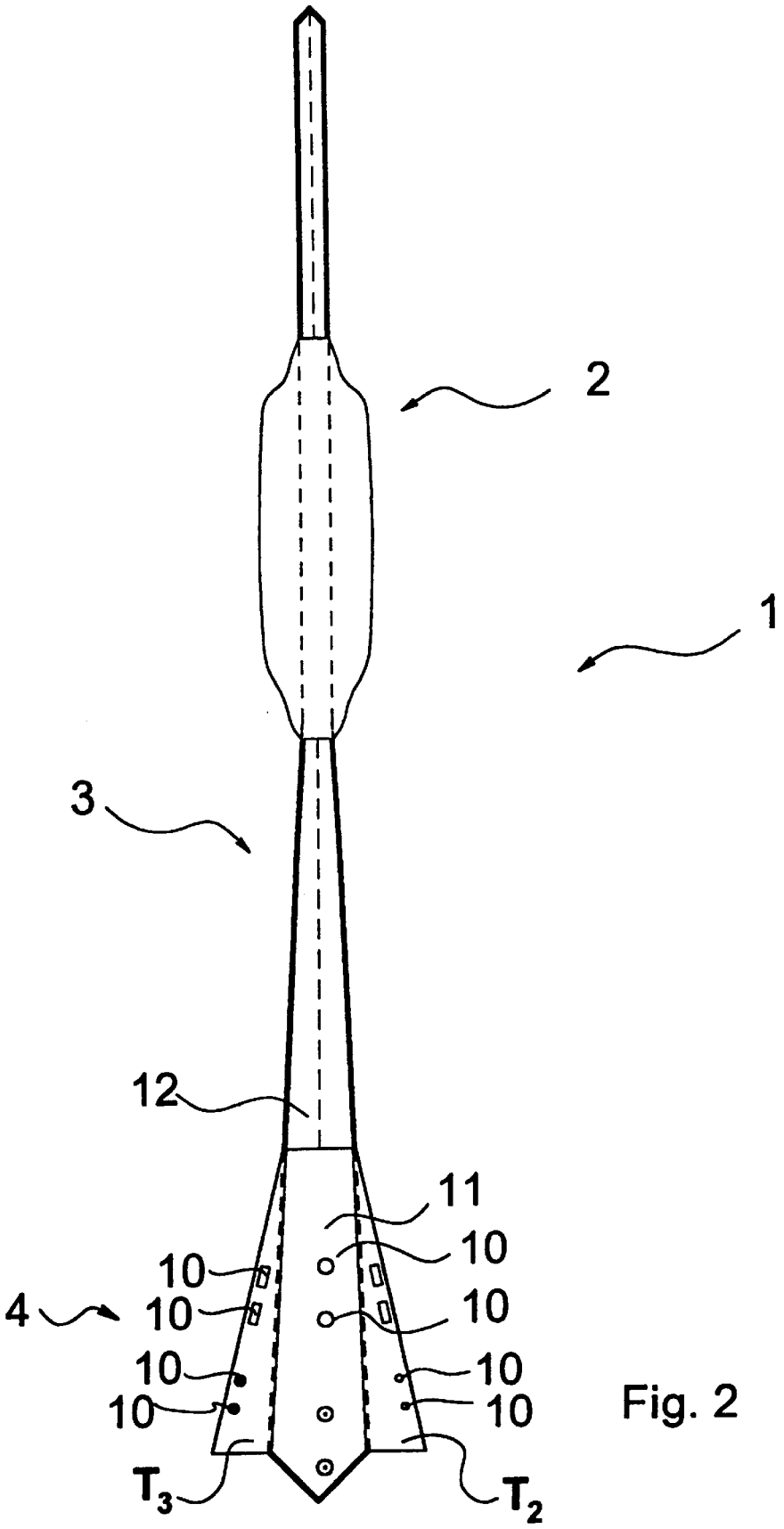
FIG. 2 shows an unfolded one-piece multipurpose necktie with an inlay.

FIG. 2 illustrates a further advantageous embodiment of a multipurpose necktie 1. The two laterally extending flaps $T_2$ and $T_3$ comprise fastening means 10. These fastening means 10 are arranged in such a manner that they interconnect at least the two flaps $T_2$ and $T_3$. The fastening means may be formed by buttons, snap fasteners, and cuffs, in the form of pins, or even a different form. A fastening with snap fasteners presents itself, when portions of flaps $T_2$ and $T_3$ overlap. Furthermore, snap fasteners have the advantage that it is not necessary to provide buttonholes in front apron 4. If the front apron 4 is made of at least two fabric layers, it will be possible to sew button holes into the one fabric layer, without becoming later visible in the opened state of the flaps. Preferably, the front apron 4 comprises at least in one section an inner layer 11 and/or and inlay 12. This inner layer 11 or inlay 12 may consist of a firmer material, so as to predetermine a certain shape, for example, of the front apron 4, when flaps $T_2$ and $T_3$ are folded. It will be advantageous, when the inner layer 11 is likewise provided with fastening means 10. Thus, for example, it will be possible to join by means of buttons first flap $T_2$ and subsequently flap $T_3$ to the inner layer 11. Otherwise, the fastening means 10 may also be attached such that a respective width of front apron 4 can be varied. Furthermore, the inner layer 11 may also extend over the entire width of flaps $T_1$, $T_2$, and $T_3$, and have a uniform pattern. A preferred material therefor is silk. Depending on the desired width, it is possible to use therefor different fastening means 10. In the illustrated embodiment, the inner layer 11 is attached by means of an inlay 12 which projects from tie portion 3. To this end, the inlay 12 or inner layer 11 may again comprise corresponding fastening means. The inlay 12 extends through tie portion 3 to neck portion 2, where it preferably forms a cushioning of same. In a particularly preferred embodiment of a multipurpose necktie, the neck portion 2 can be unfolded, so that the inlay 12 or even an inner side comes to contact the neck region. This inner side is made preferably of silk, which may also extend on the corresponding side of inlay 12. Advantageous for the production is, when tie portion 3 is sewn closed, so that inlay 12 can be attached both to neck portion 2 and to front apron 4. Consequently, the tie portion 3 which is subjected to greatest stresses when being pulled, is provided with a part of the seam that results when same is sewn together to form a tube. This seam is provided as a particularly strong seam. This seam may also be used as a connection of the tie portion to two or more flaps arid/or adjacent regions, thereby preventing in a lasting manner the thereby formed tube from tearing. Just those seams that are subjected to shearing during unfolding are therefore made especially durable. Likewise, it is advantageous to provide in addition a seam as a bar tack, which is in a position to absorb shearing forces.

Figure 3:
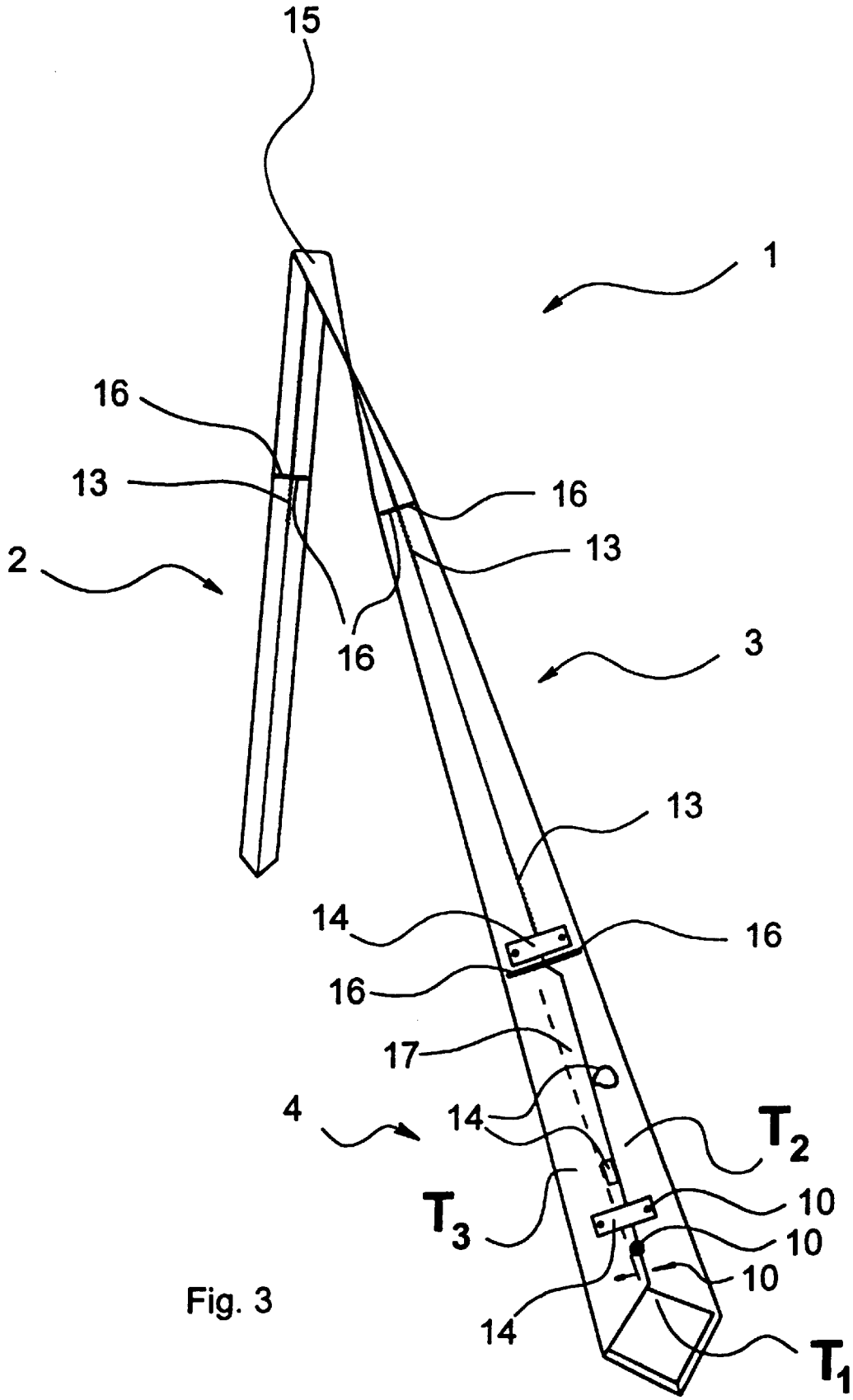
FIG. 3 shows a folded multipurpose necktie with holding and fastening means with a cover in the neck portion.

FIG. 3 shows a multipurpose necktie 1, wherein flaps $T_2$ and $T_3$ when being folded come to lie on flap $T_1$. To prevent tearing of a seam 13, the front apron 4 is provided in addition with a holding means 14. Preferably, the holding means 14 is designed and constructed such that it can be arranged for variation. Furthermore, it is able to receive the free end of neck portion 2, when a knot is tied. This free end may likewise be pulled through further holding means 14. Same may also be used with advantage, for example, in the form of a label also fastening means 10 of flaps $T_2$ and $T_3$. This combination of fastening means 10 and holding means 14 may also be achieved by means of pins or buttons and be attached for variation with suitable parts. In an advantageous embodiment, the holding means 14 are used to hold the free end of neck portion 2 as well as to indicate the material that was used to make the multipurpose necktie and the treatments that may be performed as regards cleaning etc. As illustrated, preferably two of these holding means 14 are attached to the multipurpose necktie 1. As a result, there exist, on the one hand, adequate holding possibilities the neck portion 2. On the other hand, it is possible to show different information on each of the holding means 14. In particular, it will be advantageous, when one of these holding means 14 is or can be arranged where a connecting seam 13 merges from the front apron to the neck portion and offers an additional protection against tearing or ripping of the seam. To hold the free end of neck portion 2, a holding means 14 likewise presents itself in the form of a loop, which is advantageously attached in a seam of a flap. However, it is likewise possible to use slit-shaped configurations in a flap for guiding therethrough the free end. A further development of neck portion 2 provides that same has a replaceable cover 15, which is preferably tubular and can be slipped over. This facilitates between neck portion 2 and cover 15 a connection that is advantageously secured by means of buttons. The cover 15 may be selected of such a fabric that permits cleaning. A favorable configuration of neck portion 2 further provides that a part associated to same, for example, inlay 12 is likewise exchangeable and preferably easy to clean. This applies in particular to silk fabrics, since when same are soiled, stains are only difficult to remove without leaving a permanent discoloration. Furthermore, it will be advantageous, when the freely foldable parts of the multipurpose necktie 1, be they flaps $T_2$ and $T_3$ or corresponding parts of neck portion 2, are provided with folding cuts 16 which facilitate unfolding and folding and prevent an unfolded region from forming folds.

Figure 4:
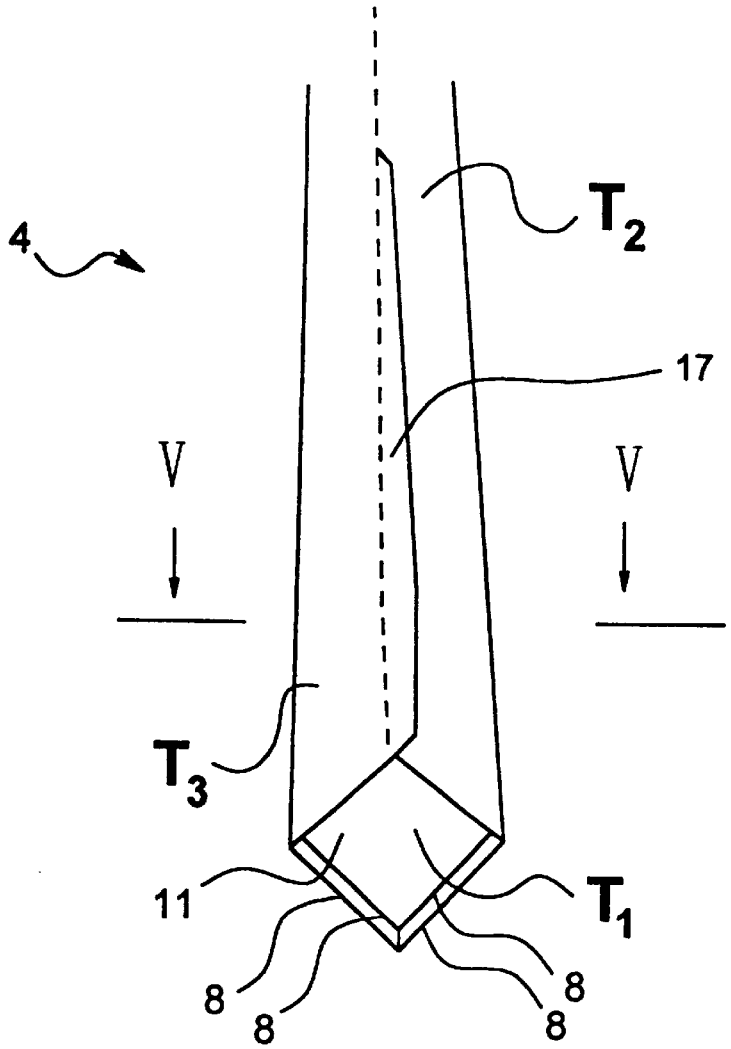
FIG. 4 shows an overlapping region of two freely foldable flaps.

FIG. 4 illustrates a preferred embodiment of a front apron with three flaps $T_1$, $T_2$, and $T_3$. The flap $T_3$ as well as flap $T_2$ are cut such that they form an overlapping fastening zone 17. Preferably, this fastening zone 17 is designed such that the used fabric exhibits a special strength, so as to show no wear as a result of frequent securing and releasing of fastening means. The front apron 4 has again an inner layer 11. Preferably, the inner layer 11 is exchangeable. To this end, it comprises corresponding fastening means with which it can be connected to the front apron. Based on the requirements that are to be met by a multipurpose necktie, it is advantageous to hem not only inner layer 11, but also corresponding edges 8 of front apron 4. With that, same offer a protection against fraying and wear. To obtain an Ascot-type shape, corresponding extra widths for an overlap are allowed to extend gently. This prevents the front apron from puckering or buckling. It will be especially advantageous, when the upper region of the front apron has a large overlap, preferably larger than the lower region. As a result, the shape of the multipurpose necktie as a cravat is predetermined based on the basic orientation of the upper region. A larger, upper overlap region can be obtained, for example, by the parallelism of the unfolded edges of the foldable part of the front apron.

Figure 5:
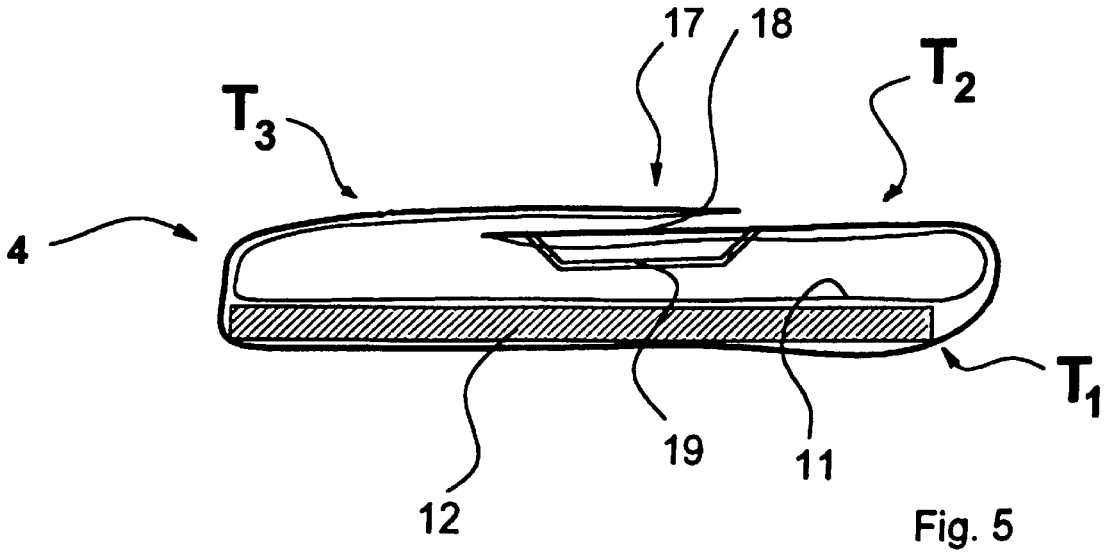
FIG. 5 is a cross sectional view of the region of FIG. 4.

FIG. 5 is a cross sectional view of front apron 4, which clearly shows the fastening zone 17. The flap $T_2$ that is overlapped by flap $T_3$ exhibits in fastening zone 17 a special configuration in the form of a defined fastening surface 18 for a holding means. This fastening surface 18 is provided with an insert 19 as a protection against a pin extending therethrough into flap $T_1$. This insert 19 possesses a trough, which permits undercutting the fastening surface 18 by means of a pin, without being able to stick the pin into flap $T_1$. This prevents corresponding destruction of flap $T_1$, and facilitates the use of fastening means. At the same time, such a protection, preferably of a plastic material, enables a variable change in width based on the possibility of making flaps $T_2$ and $T_3$ come to overlie each other differently. The insert 19 can be directly connected to the fastening surface 18. However, the most favorable position is dependent on the fabric surfaces that are to be protected, or on the location where the protective device is most useful. Preferred is also a position of the protective device below inlay 12.

Figure 6:
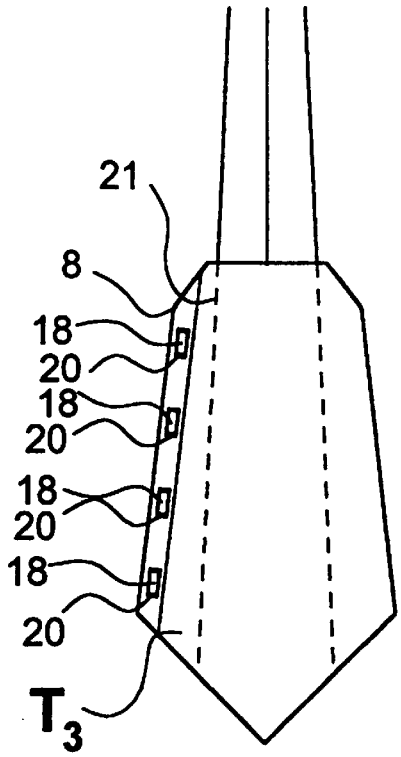
FIG. 6 shows the multipurpose necktie of FIG. 4 in an unfolded state.

FIG. 6 shows a further, advantageous embodiment for ensuring a reliable handling of fastening means. The flap $T_3$ is provided with fastening surfaces 18 that are formed by correspondingly stitched seams 20. At the same time, the stitched seams 20 prevent pulling out or tearing under a too high tensile stress at a securely attached fastening means within the fastening surface 18. Preferably, a stitched seam 20 for forming a fastening surface 18 is arranged in the outer region of a flap. There, same is provided with a seam reinforcement 21, which is indicated by a dashed line that reinforces the edge 8, preferably over a width of at least one centimeter. If the multipurpose necktie is intended for wear on both sides, it will be advantageous to arrange the stitched seams 20 such that they are invisible when tying an Ascot form.

Figure 7:
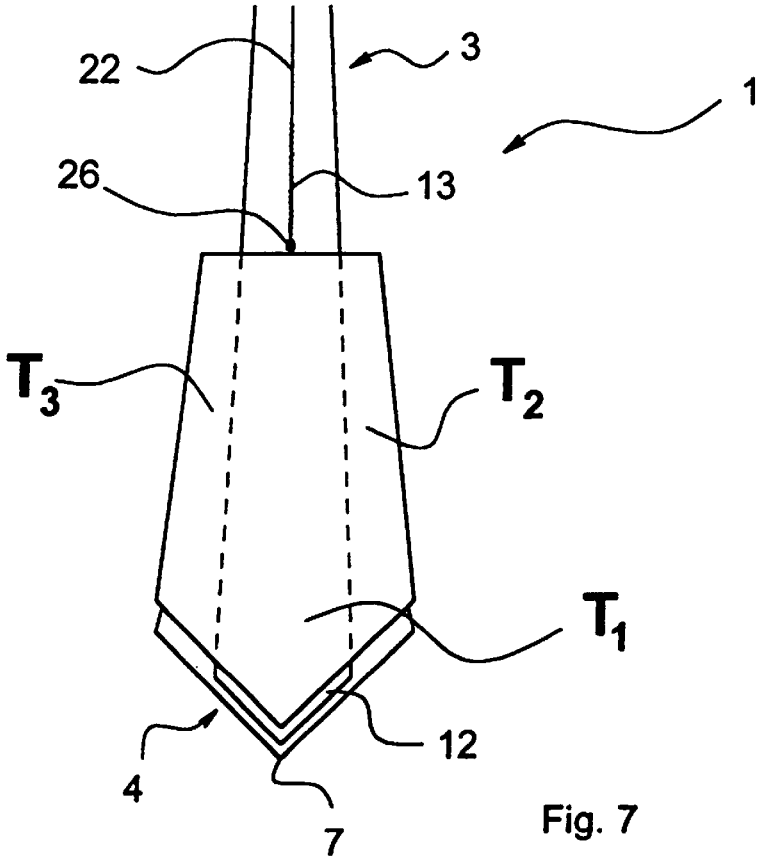
FIG. 7 shows a further development of the multipurpose necktie with an inlay.

FIG. 7 illustrates a further embodiment of a multipurpose necktie 1. The tie portion 3 is provided with a common, blind stitched seam 22, which merges in the region that is especially endangered by pull and shearing, into a reinforced seam 13 serving as a protection against tearing. Furthermore, it is advantageous to provide a transverse seam in the form of a bar tack 26 that reinforces the protection against tearing. The flaps $T_2$ and $T_3$ are composed of two layers. Each layer may consist of a different material. In the region of flap $T_1$, an insert 12 is provided, which extends from tie portion 3 down to tip 7 of front apron 4. The inlay 12 serves at the same time as an interfacing. By means of blind stitched seam 22 or seam 13 inlay 12 is joined to tie portion 3, which prevents the inlay from being pulled out. If desired, the inlay 12 is thus invariably joined to the multipurpose necktie 1 or, however, it is secured as a removable part, for example, by a cling fastener, and is thus exchangeable. This also allows varying, depending on need, the shape as well as the width of front apron 4 of a multipurpose necktie 1.

Figure 8:
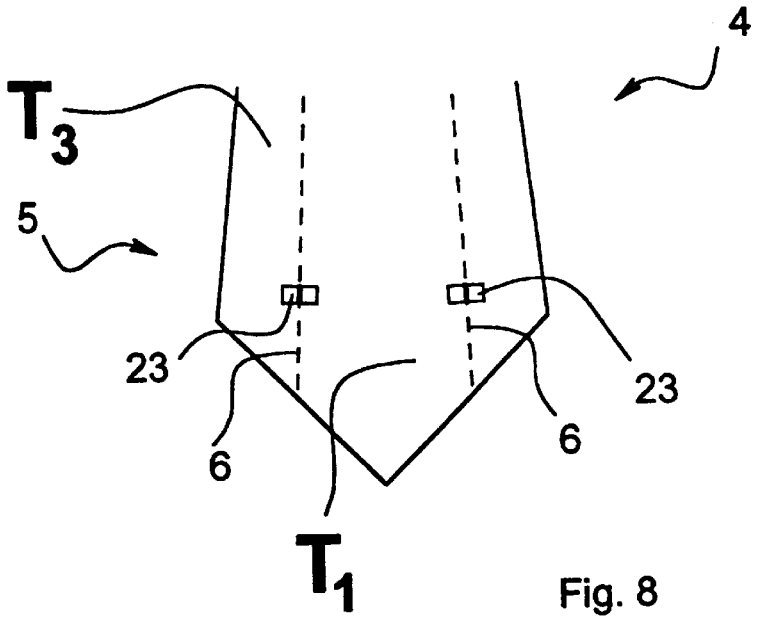
FIG. 8 shows freely foldable flaps with folding means.

FIG. 8 shows clearly a further preferred embodiment of a multipurpose necktie 1. To this end, the foldable part 5 of front apron 4 is provided on the fold lines 6 between two flaps $T_2$ and $T_1$ or $T_3$ and $T_1$ with elements 23 as folding means. These folding means have a certain stiffening function along with a hinge effect. To this end, it is preferred to apply the elements 23 for variation in the foldable part 5, so that it is possible to shift in particular fold line 6. In a further embodiment, the elements 23 can also be applied in preformed pockets within the front apron 4. This defines their position and, thus, likewise that of fold line 6. These pockets may also be constructed such that an element can be displaced and secured therein in a defined manner.

Figure 9:
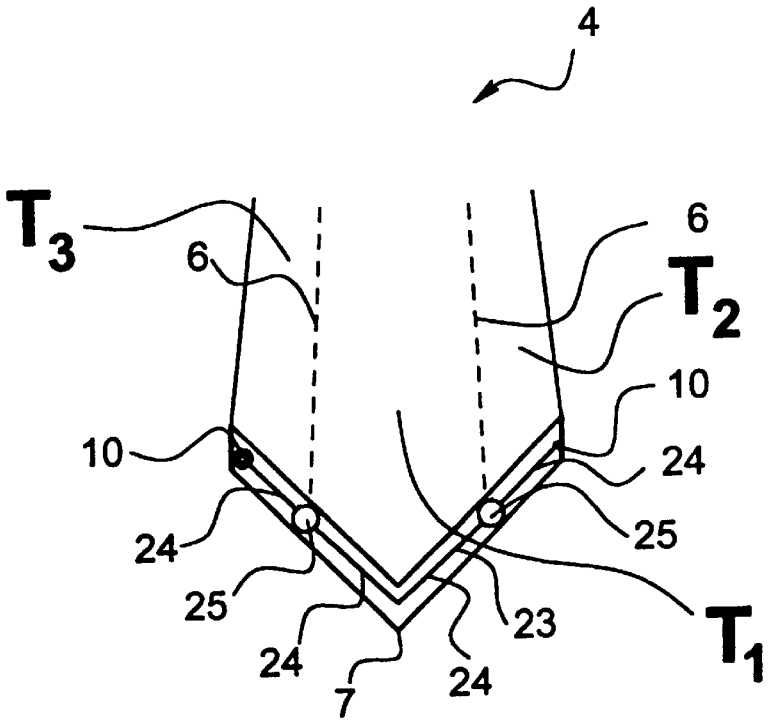
FIG. 9 shows freely foldable flaps with a further folding means.

FIG. 9 shows a further embodiment of an element 23. On the one hand, it joins the three flaps $T_1$, $T_2$, and $T_3$ to one another. To this end, the element has stays 24 that are jointed to each other by means of hinge-type devices 25. In an advantageous embodiment, the hinge-type devices may predetermine corresponding fold lines 6 of the flaps. Suitable fastening means 10, such as snap fasteners, permit joining the flaps, when folded. On the other hand, the element 23 may also be detached from flaps $T_2$ and $T_3$ and be replaced with a different element 23. As a result, it is possible to obtain again different fold lines 6. A further advantage of this embodiment is a weight concentration in tip 7 of front apron 4. With this weight concentration, it is accomplished that, even under adverse circumstances, for example, a strong wind, the multipurpose necktie 1 does not leave its correct fit in its tied form on the neck.

Figure 10:
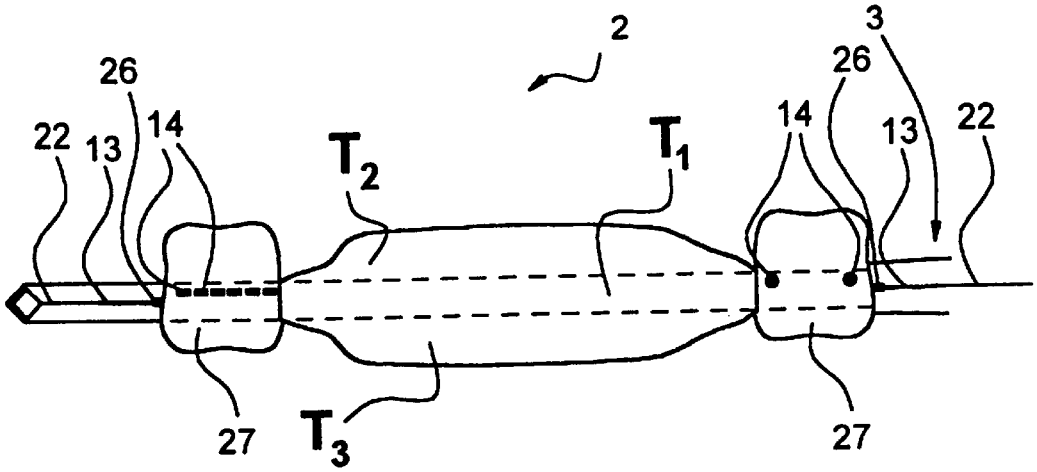
FIG. 10 shows a neck portion with its own closure.

FIG. 10 shows a further advantageous embodiment of a multipurpose necktie 1 with a neck portion 2. The neck portion 2 itself has a foldable region. The illustrated, advantageous embodiment comprises again three flaps $T_1$, $T_2$, and $T_3$, which form a freely foldable neck portion 2. Furthermore, the neck portion 2 includes fabric extensions 27, which are joined over their length in part or in full to the neck portion 2. The fabric extensions 27 comprise holding means 14, for example, buttons or buttonholes, so as to facilitate closing of the neck portion 2. By a corresponding arrangement of holding means 14, this closure can be kept variable, so as to be adaptable to different neck widths. In a further development, only one fabric extension 27 and necessary holding means are provided on neck portion 2 or in the region of tie portion 3. The fabric extensions 27, which are advantageously likewise freely foldable, offer not only the possibility of closing, but also an optical closing when multipurpose necktie 1 is worn in the fashion of an Ascot tie. They may be folded in and, advantageously, be inserted and thus concealed, in the tubular sections of neck portion 2 and/or tie portion 3. To this end, blind stitched seam 22 has again in the neck portion 2 or in tie portion 3 a reinforced seam 13 as well as a bar tack 26 by a transverse seam, which permanently prevent the sewn together tube from tearing or ripping open. Due to their use in the neck region and due to their closing, the fabric extensions 27 are more likely subjected to soiling than other parts of multipurpose necktie 1. For this reason, the fabric extensions 27 are advantageously cleanable. In this instance, it is advantageously ensured that these fabric extensions 27 are exchangeable. They can be either washed or replaced with new fabric extensions 27.

Figure 11:
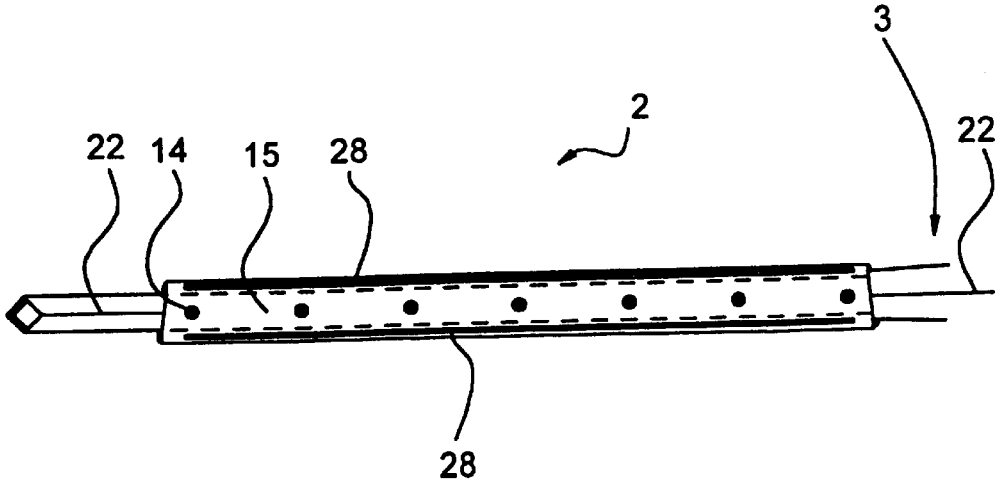
FIG. 11 shows a cover with slits.

FIG. 11 shows a neck portion 2 as well as a part of a tie portion 3 with a cover 15 slipped thereover. Same is secured by holding means 14 to neck portion 2. In this connection, the corresponding holding means 14 are advantageously applied to neck portion 2 such that they can also be secured when blind stitching seam 22. The cover 15 is provided with slits 28. It is possible to pull therethrough the foldable part of the front apron of the multipurpose necktie, when neck portion 2 is closed. As a result, it is likewise possible to realize a closing of neck portion 2. Thus, it is likewise possible to provide already in the neck portion 2 a great width of the front apron of the multipurpose necktie. In this manner, a large-surface coverage of the neck is already realized in that location.

Figure 12:
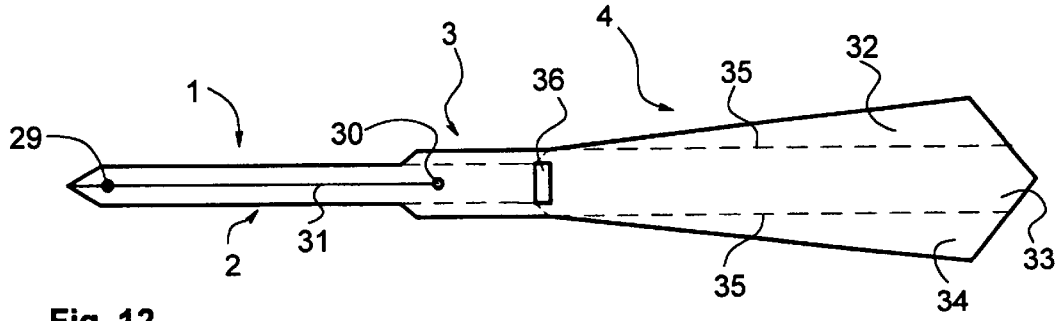
FIG. 12 shows a variable multipurpose necktie as a shawl tie for tying a loop.

FIG. 12 shows a further embodiment of a variable multipurpose necktie 1 with a neck portion 2, a tie portion 3, and a front apron 4. The neck portion 2 has a first fastening device 29, which forms the spherical part of a snap fastener. This spherical part 29 can be connected to a second fastening device 30, thereby changing the length of neck portion 2. The second fastening device 30, which forms the spring stud of a snap fastener, can be adjusted along a line 31. This allows flexibility with respect to the length variation of neck portion 2. The tie portion 3 is made wider than the neck portion 2, thereby permitting satisfactory use of the multipurpose necktie 1 as a shawl tie. If the neck portion 2 is not shortened, the multipurpose necktie 1 can be used as a long necktie. If it is no longer necessary to wear same, for example, when a festive event changes from a formal part to a rather informal part, the neck portion 2 is shortened, and a wide Ascot-type knot is tied in the wider tie portion. The front apron 4 that consists in this embodiment a first 32, a second 33, and a third flap 34, is unfolded.

FIG. 12 shows the multipurpose necktie 1 in its unfolded state. The respective fold seams 35 between flaps 32, 33, 34 are shown in dashed lines. The fold seams 35 do not stop in the region between tie portion 3 and front apron 4. Rather they extend even into the tie portion 3. Same may also change its width along the predetermined fold seam 35. However, the extension thereof is here adapted, so as to permit forming the illustrated multipurpose necktie 1 to the conventional, customary shape of a long necktie. Furthermore, a passthrough 36 is arranged between tie portion 3 and front apron 4. This passthrough may be a loop, a label, or even a cut in tie portion 3 or front apron 4. The shortened neck portion 2 is to be pulled through passthrough 36, whereby a loop is formed. This loop is placed around a person's neck, so as to convert thereafter the unfolded tie portion 3 to a scarf by wrapping it about itself several times. The loop formation and variable use of multipurpose necktie 1 is again described in greater detail below with reference to FIGS. 21 to 44.

Figure 13:
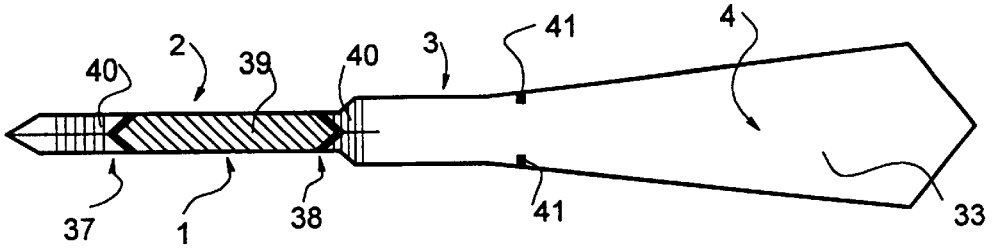
FIG. 13 shows a multipurpose necktie likewise again a shawl tie, this time for tying a knot.

FIG. 13 shows a further, variable multipurpose necktie 1. The neck portion 2 comprises a first 37 and a second 38 V-shaped cut. This cut permits a repeatable variation of the width of neck portion 2. If both V-shaped cuts 37, 38 are pulled, the material 39 extending therebetween is stretched. Advantageously, this material 39 is a stretch fabric that supports a variation of both the width and the length. This material 39 extending between the two cuts 37, 38 likewise exhibits a flexibility, when its orientation is rotated by 30° to 60°, advantageously 45° relative to adjacent other orientations of different materials 40, as is indicated by corresponding lines in FIG. 13. Furthermore, the front apron 4 comprises means 41 for forming folds. As shown, the second flap 33 is provided with gathering tapes 41 which extend into the first 32 and third 34 flaps that are folded over in the illustration and, therefore, not visible. When a knot is tied, the gathering tapes 41 see to it that flaps 32, 33, 34 pull wide apart.

Figure 14:
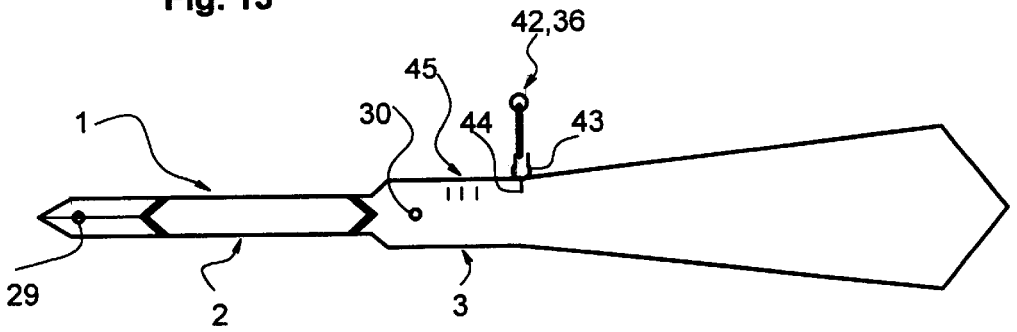
FIG. 14 shows a combination of loop and knot formation in a multipurpose necktie.

FIG. 14 shows a variable multipurpose necktie 1, which can be used for tying both a loop and a knot. By means of a first fastening device 29 and a second fastening device 30, it is possible to shorten the neck portion 2 to half its length. The fastening device 29, 30 may be located along the center seam not shown or even be offset therefrom. A lateral offset of both fastening devices 29, 30 guarantees a uniform coverage of the neck portion 2 that comes to overlie when the length is reduced. In the tie portion 3, a pin 42 is attached that serves as a passthrough 36. This pin comprises a protective cap 43, which includes a means 44 for attachment to multipurpose necktie 1. In the illustration of FIG. 14, a clip is used which clamps a part of the fabric of multipurpose necktie 1. The passthrough 36 in the form of pin 42 can thus be flexibly arranged on the multipurpose necktie 1. In accordance with the circumference of a neck, it is possible to adept tie portion 3 in terms of length by a suitable relocation of pin 42. For known neck measurements the tie portion 3 may also be provided with markings 45 which suggest corresponding points of attachment for passthrough 36. Preferred dimensions for the length of tie portion 3 range from 55 to 35 cm, preferably about 45 cm. A preferred length range for a fully elongated neck portion 2 has approximately the same dimensions. In this connection, one has to take into account that, naturally, other dimensions may be necessary for oversizes and undersizes. Further differences in the length dimensions are under circumstances likewise dependent on whether or not the variable multipurpose necktie is designed for tying only loops or knots.

Figure 15:
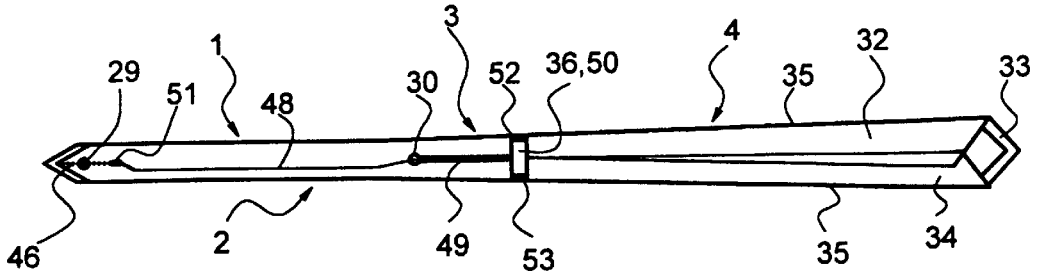
FIG. 15 shows a further combination with a different, variable neck portion.

FIG. 15 illustrates another variable multipurpose necktie 1, which also combines the possibility of forming a loop with tying a knot. The multipurpose necktie 1 is sewn together in tubular form. As can be noted, the neck portion has a first seam 46. This seam combines a tube 47 with itself. A first fastening device 29 interrupts this first seam 46. This fastening device can be connected with a second fastening device 30. Based on the arrangement of the two fastening devices 29, 30 in the neck portion 2, same can again be reduced, when shortened, to about its half. Between the first fastening device 29 and the second fastening device 30, the tube 47 that forms the neck portion 2 is to be opened along a line 48. This allows to vary the width of the neck portion 2 such that there is no longer a narrow neck portion 2 for a shirt collar, but a wide neck portion 2 for, for example, direct contact with the neck. This scarflike use of the multipurpose necktie 1 is further expansible in that scarf materials are used in the interior of tube 47. These materials may be especially skin-friendly fabrics. For a great wearing comfort of multipurpose necktie 1, use is made in particular of silk, cashmere, or a similar, comparably high quality.

In FIG. 15, the second fastening device 30 serves not only as a counterpart of the first fastening device 29. Instead, it has also the task of interconnecting different layers of fabric. These may be fabric layers of neck portion 2 or even of tie portion 3. From the second fastening device 30, a second seam 49 extends to front apron 4. The front apron 4 has again a first 32, a second 33, and a third 34 flap. These flaps can be unfolded along fold seam 35. To prevent the second seam 49 from tearing when unfolding the flaps, a label 50 is arranged as a passthrough 36 in the transitional region between tie portion 3 and the front apron. The label 50 serves as a protection against tearing in a fashion similar to end region 51 of first seam 46 that is realized as a bar tack. Otherwise, it is also possible to arrange on the multipurpose necktie 1 the first 29 and/or the second 30 fastening device in a manner similar to a bar task. At its opposite ends 52, the label 50 is secured, preferably by two seams stitched side by side or on top of each other. As a result, when the neck portion 2 is pulled through the label 50, same can be separated from the multipurpose necktie 1 only with brutal force.

To further assist in the shape variation of front apron 4, in the region of fold seam 35 of the multipurpose necktie 1 shown in FIG. 15, the fabric, in particular the upper fabric is woven in such a manner that it is thinner than other adjoining regions. This is possible, for example, by weaving warp and weft offset by 45°. Another possibility of assisting in the folding along seam 35, consists in joining thereat each of flaps 32, 33, 34 in such a manner that a kind of groove is formed. This is also possible by using there a thinner fabric.

Figure 16:
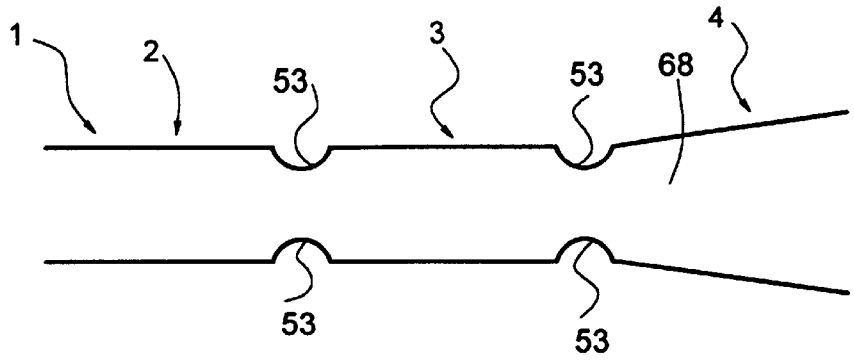
FIG. 16 shows a possibility of avoiding fabric overlaps at transitions of the multipurpose necktie.

FIG. 16 is a cutout view of an embodiment of a multipurpose necktie 1. Between the neck portion 2 and the tie portion 3 as well as between the tie portion 3 and front apron 4, the material of the multipurpose necktie 1 contains reductions 53 in the cross sectional area. These reductions in the cross sectional area prevent the material from overlapping, when folding parts of the multipurpose necktie 1 that are to be opened and closed, for example flaps 32, 33, 34, or the region of neck portion 2 that is to be opened. The overlaps of the material lead to thickening that can result in pressure marks as well as chafe marks in particular in the neck region. A suitable cut in those regions, wherein unfolding and folding or another width variation occur, prevents the material from superposing. Such a cut, for example, the reduction 53 in the cross sectional area, can also be combined with the V-shaped cut 37, 38 in FIG. 13. Furthermore, between neck portion 2 and front apron 4, a cut 68 is arranged as a passthrough for tucking in the free end of neck portion 2, when a shortening is desired.

Figure 17:
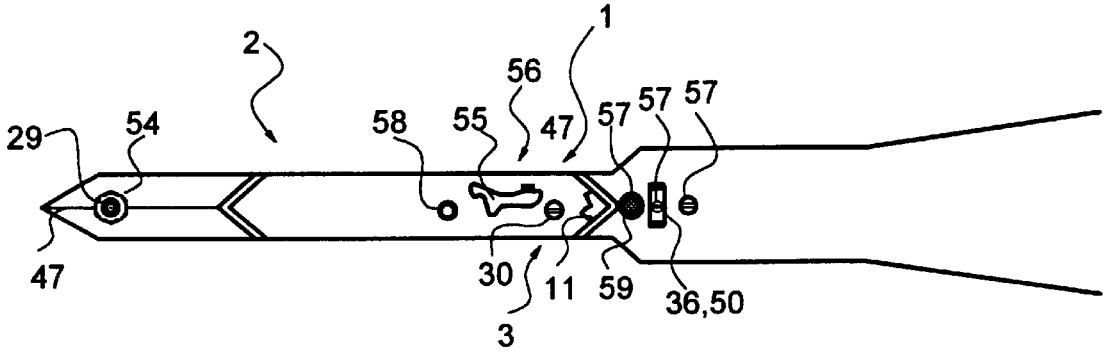
FIG. 17 shows a further embodiment of a multipurpose necktie.

FIG. 17 shows a further multipurpose necktie 1. Same comprises a first fastening device 29, which is only visible, since a break 54 is shown. The first fastening device 29 in neck portion 2 is a rivet head. Same extends through all overlying fabrics, but is covered by sewing together the tube 47. The rivet head 29 can also be covered on its other side by tube 47. In this instance, the rivet head holds together those fabric layers that are in the tube 47. In a further embodiment, the rivet head 29 is visibly arranged on both sides and thus holds likewise tube 47. The second fastening device 30 can be covered by a fabric allowance 55. As shown in FIG. 17, the fabric allowance 55 is raised, so that the second fastening device 30 is visible. The fabric allowance 55 may be arranged in neck portion 2 such that the fastening device 30 disappears in a kind of niche that is thereby formed. From this niche, the fastening device is released only when needed. The fabric allowance 55 also serves as a protection. It prevents the second fastening device 30 from directly contacting the neck, thus avoiding injuries, for example by chafing, when the multipurpose necktie 1 is moved around the neck.

The multipurpose necktie 1 as shown in FIG. 17 has a third fastening device 57 in addition to the second fastening device 30 that is arranged adjacent the beginning 56 of the variable neck region. The third fastening device 57 is arranged adjacent the passthrough 36. The passthrough 36 in the form of label 50 facilitates again the formation of loops of the multipurpose necktie 1. Furthermore, positions of the third fastening device 57 are indicated in dashed lines, which are all arranged at least adjacent the beginning of foldable front apron 4. As a result of using two or more fastening devices, the multipurpose necktie 1 becomes highly variable in the length variation of the neck portion 2. This allows using the multipurpose necktie not only for one person, but also for more persons. For example, when worn as a long necktie, the multipurpose necktie 1 is suitable for men. However, in its function as an Ascot-type scarf, it is rather suitable for men and women. The fastening devices 30, 57 may be arranged especially in such a manner that they correspond to the average neck of men and women.

Furthermore, as shown in FIG. 17, the proximity of the third fastening device 57 to label 50 likewise provides a double possibility of fastening when loops are formed of the multipurpose necktie 1. By shortening the neck portion 2 in that first fastening device 29 is connected with second fastening device 30, same is reduced by about half of its length. While this loop is formed, a fourth fastening device 58 becomes visible, which is indicated in dashed lines next to fastening device 30. In the illustration of FIG. 17, the fourth fastening device 58 is arranged on the nonvisible side of the multipurpose necktie 1. It is designed such that it can engage third fastening device 57. This permits defining the length of the tie portion 3 that is to be looped as a function of the neck size. A further development of this embodiment provides that the fourth fastening device 58 as well as the second fastening device 30 become one that is usable on both sides of the multipurpose necktie 1.

Furthermore, the third fastening device 57 is provided with a material coating 59, which is indicated by checks. The material protection 59 serves again as a protection. However, at the same time, it is used as insulation. If the multipurpose necktie 1 is in a cold surrounding, it will be uncomfortable to a person, when metal parts of the multipurpose necktie that are adapted to this temperature come into direct contact with the skin. The material coating 59 prevents this. According to a further concept of the invention, an inner layer 11 is provided at the beginning 56 of the variable neck region. As indicated already in this Figure, this inner layer can be pulled out of tube 47. Thus, the inner layer 11 serves to widen the neck portion 2 when the multipurpose necktie 1 is used as a scarf. When the inner layer 11 is no longer needed, it can be tucked back into the tube 47. The inner layer 11 is secured in this embodiment of the multipurpose necktie 1 with the use of the third fastening device 57. It is thereby ensured that the inlay 12 cannot be torn off the multipurpose necktie 1 even when strong pulling forces are applied.

Figure 18:
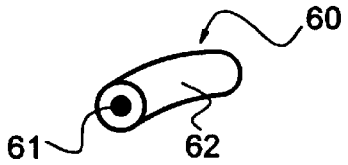
FIG. 18 shows a bar tack.

FIG. 18 shows a crossbar 60. The crossbar 60 can be used as a passthrough 36, but may also be applied inside the tube 47 and, thus, in the interior of multipurpose necktie 1. Advantageously, it is used to secure fabric areas of the multipurpose necktie 1. To facilitate passage of fabric along the crossbar 60, same is constructed in layers. A core 61 is surrounded by a layer 62, which may consist of fabric or other materials. In one embodiment, the layer 62 is arranged for rotation about core 61. In another embodiment, the layer 62 has such a low coefficient of friction that even over longer periods of use of the multipurpose necktie 1, the fabric passing therealong will show no wear or only unnoticeable traces thereof.

Figure 19:
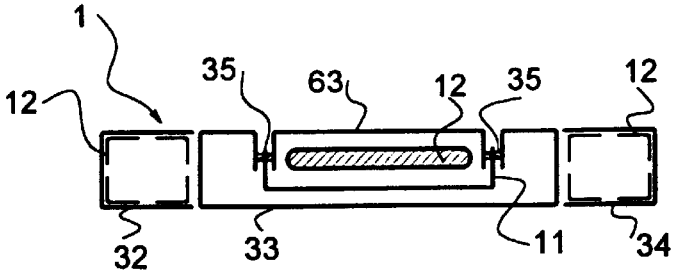
FIG. 19 is a cross sectional view of a multipurpose necktie with an inlay and an inner layer.

FIG. 19 is a cross sectional view of a multipurpose necktie 1. An inlay 12 is arranged in the interior of the multipurpose necktie 1. It is held by inner layer 11 on the one side and by a backside 63 of second flap 33 on the other side. The inlay 12 can be used for imparting a shape to the multipurpose necktie 1. It can also be used for providing a warming effect in the neck region. An inlay 12 may extend not only in the second flap 33, but also the first flap 32 and the third flap 34 may comprise an inlay 12. Dashed lines indicate these inlays, since they would otherwise not be visible in this cross sectional view. Thus, the multipurpose necktie 1 may comprise several inlays 12, which may however be even connected and which are constructed as individual inlay 12. In a further embodiment, the inlay 12 is arranged for exchange in the multipurpose necktie 1. The same also applies to inner layer 11. Furthermore, the inner layer 11 may also be attached to inlay 12. In this instance, the multipurpose necktie 1 may comprise additional fastening means for the inlay 12. These fastening means are, for example, straps, loops, or slings. It is likewise possible to secure the inner layer 11 by means of a label or a different passthrough not shown. The illustrated fold seams 35 are designed such that they provide on the one hand a lasting connection between the thus-joined parts. On the other hand, they predetermine the fold line, along which the first flap 32 and the third flap 34 are folded.

Figure 20:
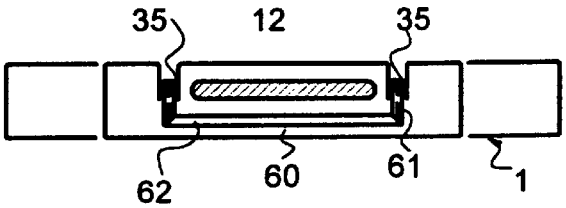
FIG. 20 is a further cross sectional view of a multipurpose necktie with an inlay and a bar tack.

FIG. 20 is a further cross sectional view of another multipurpose necktie 1. In this embodiment, the inlay 12 is secured by crossbar 60. This embodiment is useful with exchangeable inlays 12, since it facilitates passage of the inlay 12 in the multipurpose necktie 1. The use of a plurality of crossbars 60 along the length of the multipurpose necktie 1 ensures that the inlay 12 does not dislodge. It is possible to exchange inlay 12, for example, by pulling it out of from the beginning 56 the variable region of neck portion 2 of FIG. 6. In this instance, the tube 47 is inwardly open and not sewn together. To secure the inlay 12, the third fastening device 57 of FIG. 17 may be used. In this instance, the fastening device is constructed such that it has a fastening possibility in the interior of tube 47, which can be connected to a corresponding fastening possibility on the inlay 12. In FIG. 20, the core 61 of crossbar 60 is indicated in dashed lines. If it is desired that the layer 62 be rotatable, the core 61 will be secured in the fold seams 35. In one embodiment of the multipurpose necktie 1, the inlay 12 is arranged only in a part of front apron 4, in another embodiment, the inlay 12 extends over the entire front apron and even at least in part into the tie portion 3. It is also possible to arrange a plurality of inlays 12 one after the other in the multipurpose necktie 1. In a useful embodiment, the neck portion 2 has no inlay 12 in those regions that can be widened or lengthened. Thus, the multipurpose necktie 1 represents a new combination by its usability as a long necktie with that of a scarf.

The following FIGS. 21 to 32 illustrate how a variable multipurpose necktie with loop formation can be converted with a loop formation from its long necktie form to its scarf form.

FIG. 21 shows multipurpose necktie 1 in its form of a long necktie. The first fastening device 29, shown in more detail in FIG. 22, and the second fastening device 30, shown in more detail in FIG. 23, can be secured to each other. Between them, neck portion 2 extends. The multipurpose necktie 1 comprises a label 50 for use as a passthrough 36. Between the second fastening device 30 and label 50, the tie portion 3 extends. In front apron 4, a pin 42 is held in fabric cuts 64 that are specially provided to this end. Together, the neck portion 2 and the tie portion 3 have a length A. The tie portion 3 has a length B, and the neck portion 2 a length H. These three lengths A, B, H are to be dimensioned such that they meet on the one hand with the condition of using the multipurpose necktie 1 as a long necktie. This means that there is available an adequate tie portion 3 as a shaping region for the knot, as well as an adequate length H of the neck portion 2 in accordance with the neck circumference. Likewise, the length H must be such that even when using the multipurpose necktie 1 as a scarf, an adequate length is available for wrapping around the neck. For the length B of the tie portion 3, it is preferred that same extend at least over such a length that, when neck portion 2 is placed around the neck and the tie portion 3 is subsequently looped, the passthrough 36 is not tied into the thus-formed knot after two wraps. It is especially preferred to select the length B such that in the case of a preterminable tying, the passthrough 36 just lies on the tied knot, and the front apron 4 can be unfolded. By a suitable selection of the spacing between the second fastening device 30 and the passthrough 36, primarily any length B is also adapted to a certain kind of knot tying, for example, a Windsor knit.

FIG. 24 shows the shortening of the length H of neck portion 2 to about its half. At the same time, the pin 42 of protective cap 43 is separated from multipurpose necktie 1, where it has held the first flap 32 secured to third flap 34 to form the long necktie. As shown in FIG. 25, the first fastening device 29 is attached to the second fastening device 30, so as to obtain the condition of the multipurpose necktie 1 with its front apron 4 unfolded, as shown in FIG. 26.

FIG. 27 shows how the halved neck portion 2 is guided through label 50, thereby forming, when viewed from the front, the multipurpose necktie 1 shown in FIG. 28.

Figure 29:
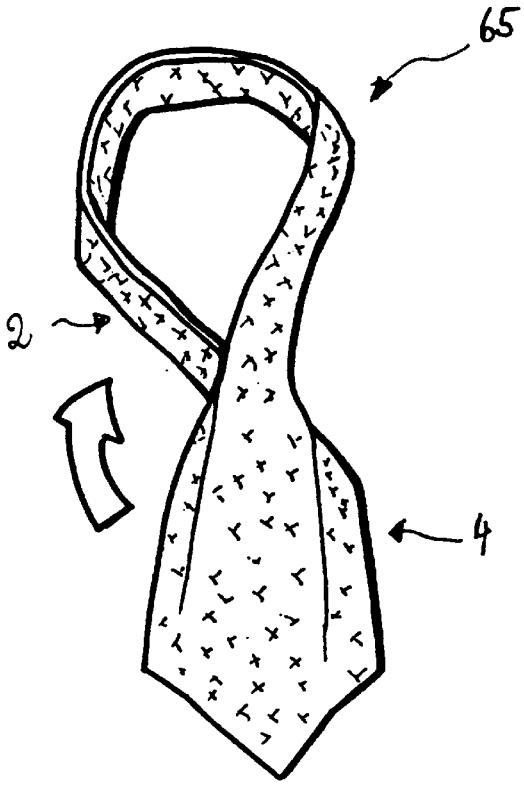
Figure 30:
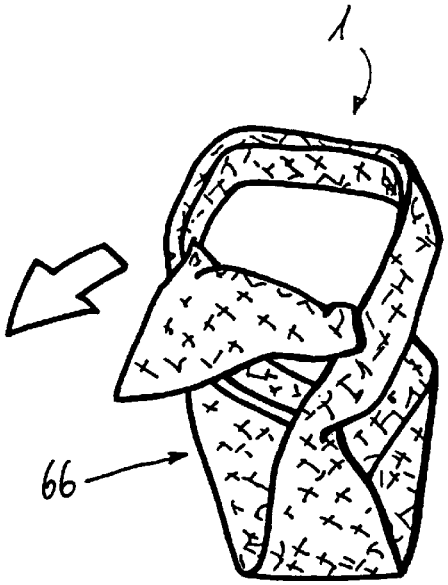
Figure 31:
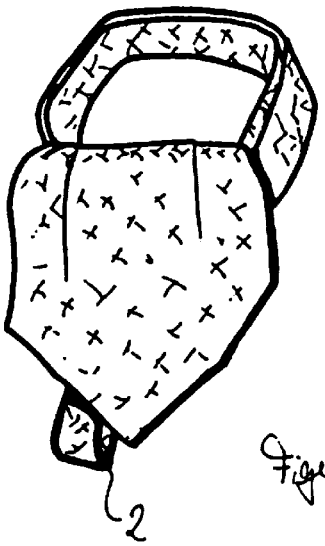
Figure 32:
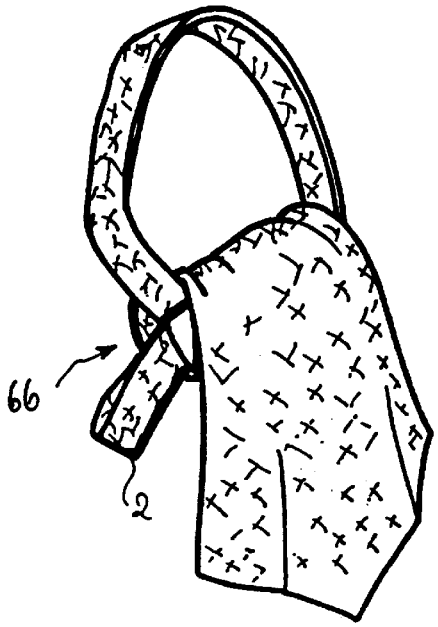
Figure 33:
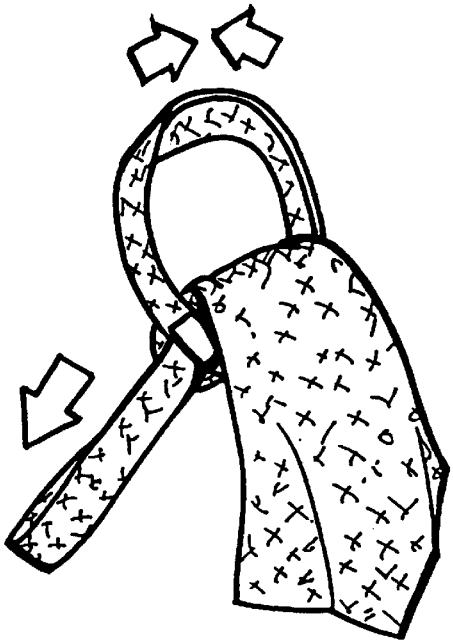

FIG. 29 shows the formation of a first loop 65 by crossing the halved neck portion 2 through the unfolded front apron 4. The front apron 4 is now guided from the bottom along the direction of the arrow upward through the first loop 65. This results in a first wrap in the multipurpose necktie 1, as is realized in the illustration of FIG. 30. By pulling the front apron 4 forward along the direction of the arrow, the first loop 65 becomes a sling, in which a looped region 66 is displaceable along the halved neck portion 2. FIG. 31 shows the halved neck portion 2 as it shows below the unfolded front apron 4. The front apron 4 is guided from the bottom upward through the sling and subsequently around same in particular until the label 50 is just no longer visible, but is located inside the looped region. In this manner, the label 50 serves as a marking for a correct fit of the thus-realized scarf form of the multipurpose necktie 1. FIG. 32 is again a side view of the looped region 66, wherein the halved neck portion 2 is movable, so that the neck width can be reduced by pulling. This change in the neck width is likewise illustrated in FIG. 33.

The following FIGS. 34–45 illustrate the use of the multipurpose necktie 1 as an Ascot tie with a tied knot.

Figure 34:
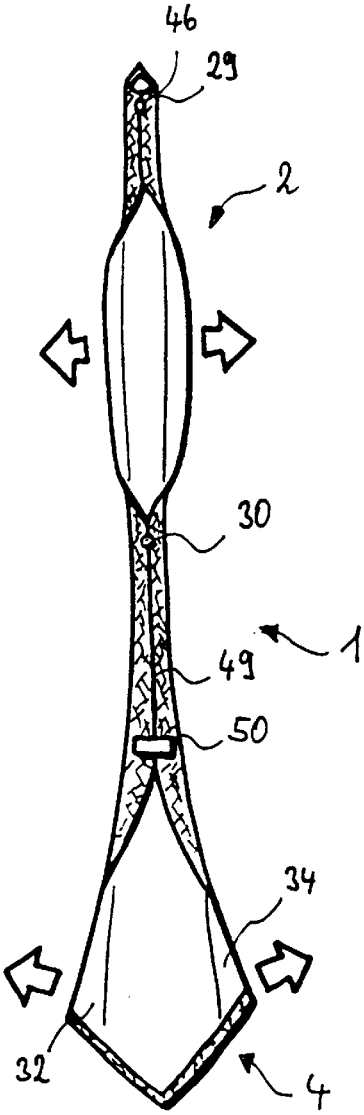
FIGS. 34 to 44 show the use of another multipurpose necktie as a shawl tie with tying a knot.
Figure 35:
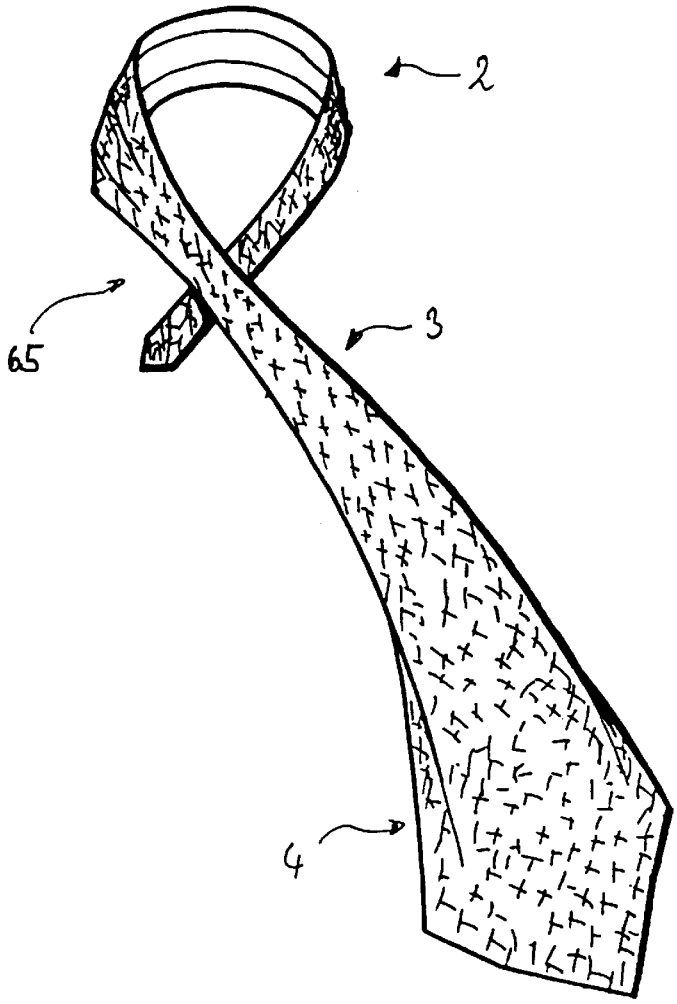
Figure 36:
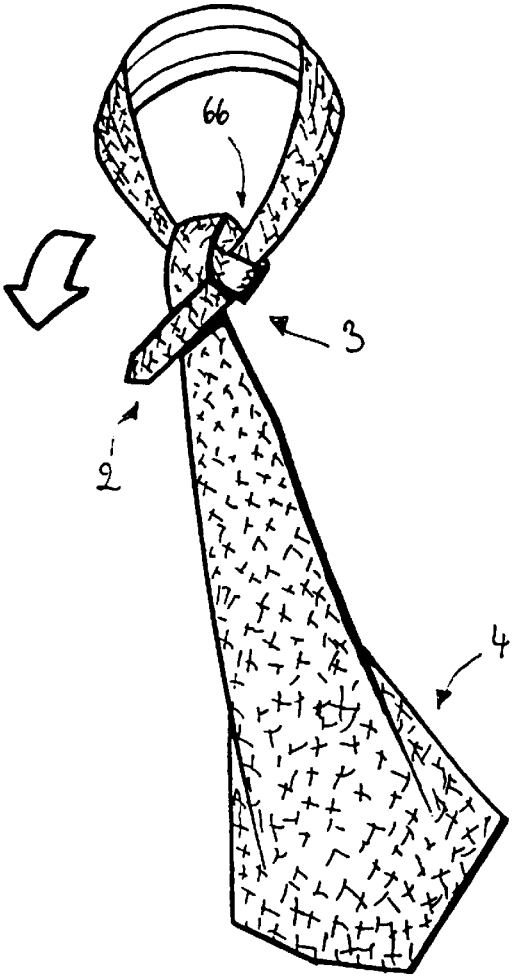
Figure 37:
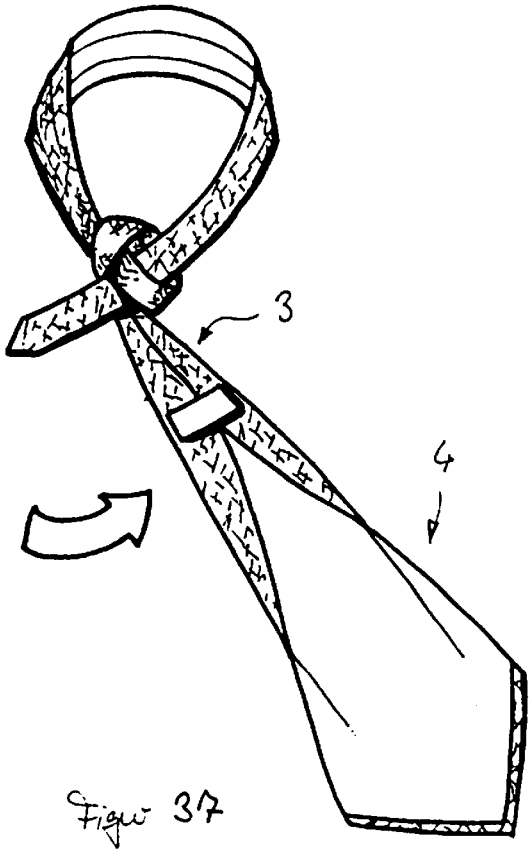
Figure 38:
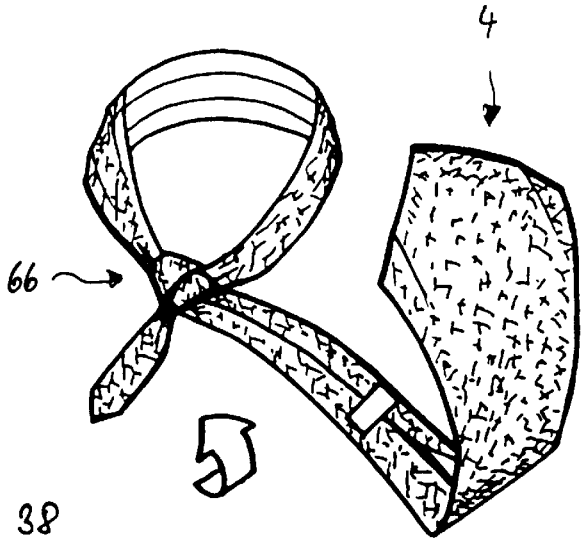
Figure 39:
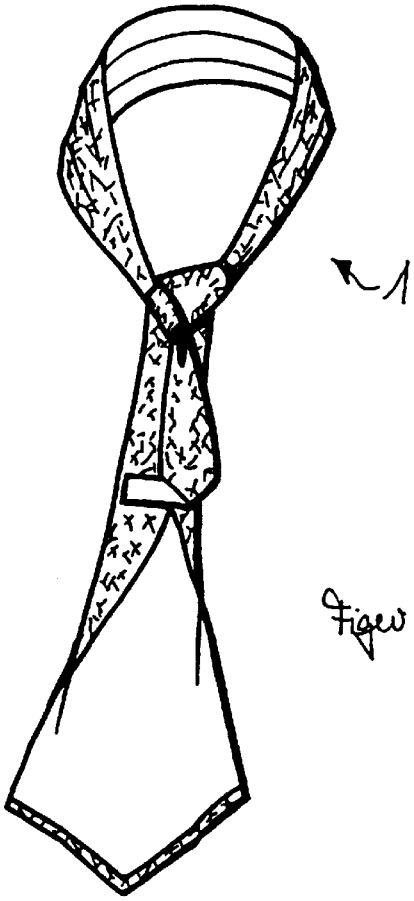

In FIG. 34, the multipurpose necktie 1 comprises a foldable neck portion 2. Same is defined by the first fastening device 29 and the second fastening device 30. Furthermore, the front apron 4 is likewise foldable. Unfolding of the first flap 32 and the third flap 34 is limited by label 50 that prevents the second seam 49 from tearing, as does the second fastening device 30. The first fastening device 29 prevents first seam 46 from tearing. As shown in FIG. 35, the now unfolded neck portion 2 is formed to the first loop 65 by crossing with the front apron 4 and the tie portion 3. Subsequently, the front apron 4 is guided from the bottom inward into the first loop 65, and pulled out at the top from the thus-formed sling. As shown in FIG. 36, the front apron 4 is then guided from the top by crossing a first part of the tie portion 3 to below a part of neck portion 2. This forms the looped region 66. Shown in FIG. 37 is how the front apron 4 is turned by 180° in the not yet looped part of tie portion 3. Subsequently, as shown in FIG. 38, the front apron is again guided from the top into the loop about the looped region 66, so as to obtain the state of the multipurpose necktie 1 shown in FIG. 39.

Figure 40:
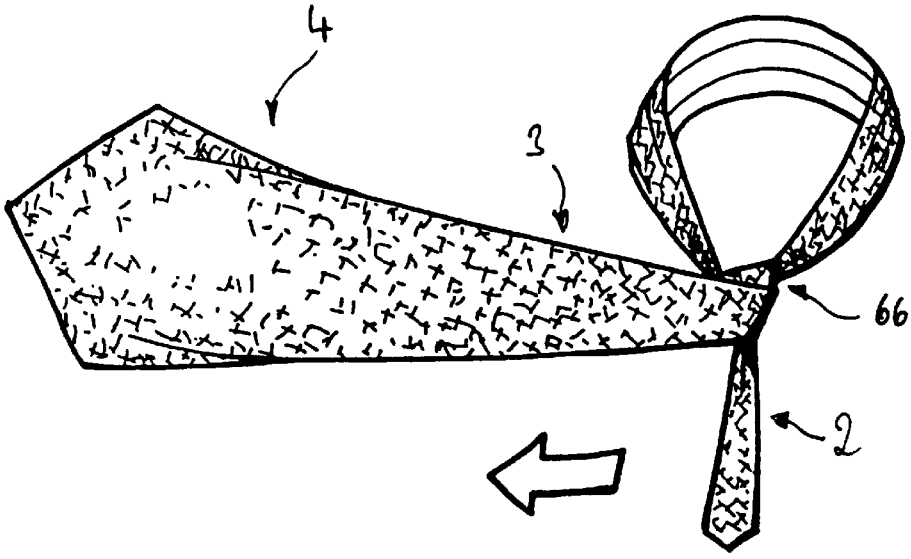
Figure 41:
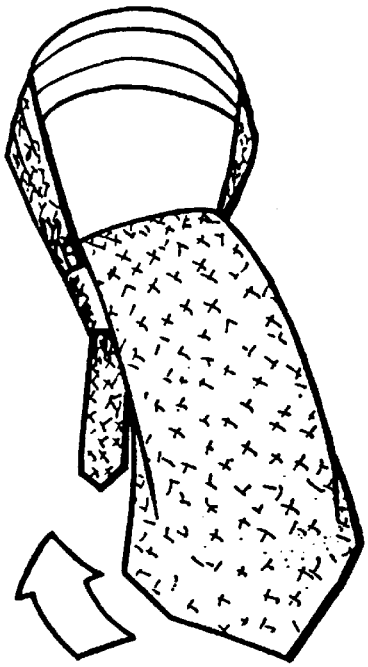
Figure 42:
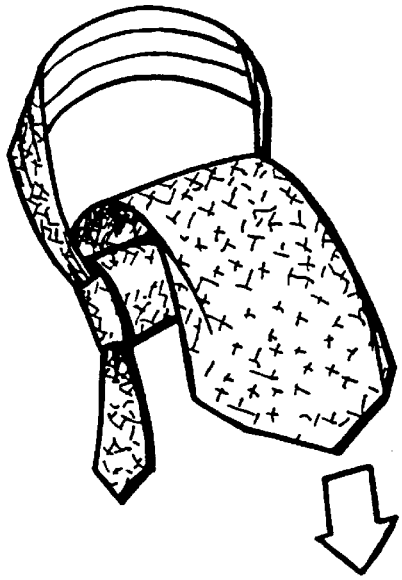

FIG. 40 shows how the front apron 4 is guided over the looped region 66 and, thus, likewise over the downward projecting neck portion 2, before it can again be pulled from the bottom upward through the sling. By this looping in circular motions with a right-hand wrapping, the tie portion 3 is formed to a knot, until outside of the thus-formed looped region 66, the label 50 is no longer visible from the outside. This is necessary, since the label 50 marks the beginning of the foldability of the flaps. The last wrapping procedure is shown in FIGS. 41 and 42.

Figure 43:
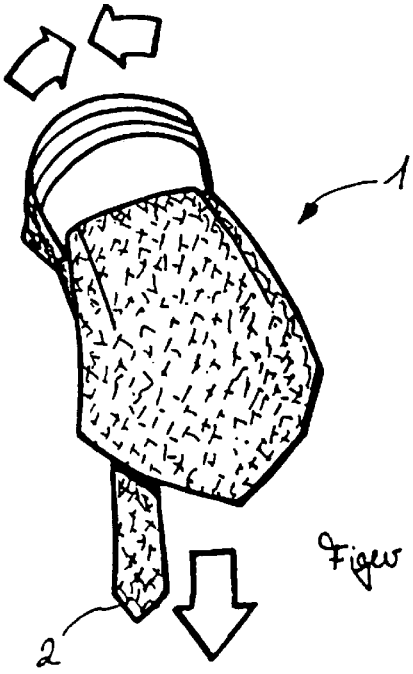
Figure 44:
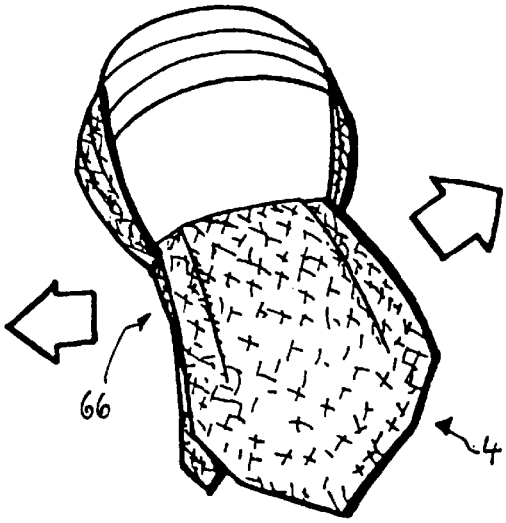

The multipurpose tie shown in FIG. 43 with a tied knot is likewise adjustable in its neck width by pulling the neck portion 2 as in the case of a loop formation. Once the correct neck width is found, the unfolded front apron 4 is again pulled apart, as shown in FIG. 44, so that the looped region 66 is no longer visible toward the outside.

The construction of the multipurpose tie as well as the kind of tying makes it clear that contrary to tying a knot in long neckties, wherein the looping for the knot formation would be dependent on the projecting length of the front apron, which defines the visible length of same, the looping for the knot formation in the case of multipurpose necktie 1 is dependent on the tie portion 3 and on the beginning of the opening of front apron 4.

FIG. 45 shows a further possibility of varying the overall length of a multipurpose necktie 1. Sections of multipurpose necktie 1 are overlapped and interconnected by means of the first 29 and the second 30 fastening device.

FIG. 46 shows a particularly advantageous length distribution between neck portion 2, tie portion 3, and front apron 4, when shortened to a scarf. The front apron has a length from 40 cm to 60 cm, in particular about 50 cm. This length is sufficient for the use as a necktie as well as a scarf.

FIG. 47 shows, how the fabric surrounding the first fastening device 29 has at least in part a gathering 67. This detail is used only for providing a protection of the skin, which comes into contact with the first fastening device 29 or the second fastening device 30, when the multipurpose necktie is tied. By the gathering 67, the first fastening device 29 is covered at least in part by the fabric. The gathering 67 may also be realized such that the fastening device 29 quasi disappears in same and is exposed only when the fastening device 29 is used.

The multipurpose necktie of the present invention is characterized by its variety for different occasions, be they of the formal or casual kind. In the same manner as a multipurpose necktie can be used for different occasions, it is also possible to combine different fabrics and materials in different sections of the multipurpose necktie. In this instance, it is possible to select, depending on the region of wear, a more skin-friendly fabric than, for example, a more decorative material. As a fashion accessory, such a shapeable multipurpose necktie offers likewise the possibility of wear not only in an appropriate manner by men, but also by women as a scarf or the like with blouses.

What is claimed is:

1. A multipurpose necktie comprising a one piece length of fabric material having two ends and consisting of a neck portion adjacent one end of the necktie, a front apron portion adjacent the opposite end of the necktie, and an intermediate tie portion which has a length sufficient for tying a knot, and with said front apron portion comprising at least two flaps which are each freely foldable about a lengthwise extending fold line, and a pair of complementary mating fastener components which are releasably interconnectable and mounted so that one of said complementary mating fastener components is located adjacent said one end of the necktie and a second one of said complementary mating fastener components is located at an intermediate location along the length of said necktie.

2. The multipurpose necktie as defined in claim 1 wherein the apron portion comprises a central flap and two outer flaps on respective opposite sides of the central flap, with each outer flap joined to the central flap along a lengthwise extending fold line.

3. The multipurpose necktie as defined in claim 2 further comprising a pin for releasably holding the two outer flaps folded over the central flap.

4. The multipurpose necktie as defined in claim 1 wherein the apron portion has a length of at least about 30 cm.

5. The multipurpose necktie as defined in claim 1 wherein the fabric material includes a gathering adjacent one of said fasteners.

6. The multipurpose necktie as defined in claim 1 wherein the neck portion comprises a folded portion of the fabric material which is selectively foldable in order to vary the width of the neck portion.

7. The multipurpose necktie as defined in claim 6 wherein the neck portion includes a pair of cuts that facilitate the unfolding thereof.

8. The multipurpose necktie as defined in claim 1 further comprising a pin which has a protective cap for fastening the necktie in a desired configuration.

9. The multipurpose necktie as defined in claim 1 wherein the second one of said complementary mating fastener components is positioned adjacent the juncture of said neck portion and said tie portion.

10. The multipurpose necktie as defined in claim 9 further comprising means mounted at a location adjacent the intersection between said tie portion and said apron portion and so as to define a passthrough for receiving the neck portion of the necktie.

11. The multipurpose necktie as defined in claim 10 wherein the passthrough is a label.

12. The multipurpose necktie as defined in claim 10 wherein the passthrough is configured by a pin having a protective cap.

* * * * *